US009286909B2

(12) United States Patent
Perez Gonzalez et al.

(10) Patent No.: US 9,286,909 B2
(45) Date of Patent: Mar. 15, 2016

(54) METHOD AND SYSTEM FOR ROBUST AUDIO HASHING

(75) Inventors: Fernando Perez Gonzalez, Pontevedra (ES); Pedro Comesana Alfaro, Pontevedra (ES); Luis Perez Freire, Pontevedra (ES); Diego Perez Vieites, Pontevedra (ES)

(73) Assignee: BRIDGE MEDIATECH, S.L., Ourense (ES)

( * ) Notice: Subject to any disclaimer, the term of this patent is extended or adjusted under 35 U.S.C. 154(b) by 189 days.

(21) Appl. No.: 14/123,865

(22) PCT Filed: Jun. 6, 2011

(86) PCT No.: PCT/EP2011/002756

§ 371 (c)(1), (2), (4) Date: Mar. 12, 2014

(87) PCT Pub. No.: WO2012/089288

PCT Pub. Date: Jul. 5, 2012

(65) Prior Publication Data

US 2014/0188487 A1 Jul. 3, 2014

(51) Int. Cl.
*G10L 19/00* (2013.01)
*G10L 25/18* (2013.01)

(52) U.S. Cl.
CPC ..... *G10L 25/18* (2013.01); *G10L 19/00* (2013.01)

(58) Field of Classification Search
CPC ..... G10L 19/018; G06F 17/30743
See application file for complete search history.

(56) References Cited

U.S. PATENT DOCUMENTS

| | | | | |
|---|---|---|---|---|
| 7,460,994 | B2 * | 12/2008 | Herre et al. | 704/231 |
| 2003/0086341 | A1 * | 5/2003 | Wells et al. | 369/13.56 |
| 2012/0209612 | A1 * | 8/2012 | Bilobrov | 704/270 |

FOREIGN PATENT DOCUMENTS

EP 1 253 525 A2 10/2002

OTHER PUBLICATIONS

International Search Report of PCT/EP2011/002756 dated Feb. 14, 2012.

* cited by examiner

*Primary Examiner* — Douglas Godbold
(74) *Attorney, Agent, or Firm* — Lucas & Mercanti, LLP

(57) ABSTRACT

Method and system for channel-invariant robust audio hashing is provided with a robust hash extraction step where a robust hash is extracted from audio content dividing the audio content in frames; applying a transformation procedure on the frames to compute, for each frame, transformed coefficients; applying a normalization procedure on the transformed coefficients to obtain normalized coefficients, where the normalization procedure computes the product of the sign of each coefficient of the transformed coefficients by an amplitude-scaling-invariant function of any combination of the transformed coefficients; applying a quantization procedure on the normalized coefficients to obtain the robust hash of the audio content; and a comparison step where the robust hash is compared with reference hashes to find a match.

12 Claims, 10 Drawing Sheets

METHOD AND SYSTEM FOR ROBUST AUDIO HASHING

CROSS-REFERENCE TO RELATED APPLICATIONS

This application is a 371 of PCT/EP2011/002756 filed on Jun. 6, 2011, the contents which are incorporated herein by reference.

FIELD OF THE INVENTION

The present invention relates to the field of audio processing, specifically to the field of robust audio hashing, also known as content-based audio identification, perceptual audio hashing or audio fingerprinting.

BACKGROUND OF THE INVENTION

Identification of multimedia contents, and audio contents in particular, is a field that attracts a lot of attention because it is an enabling technology for many applications, ranging from copyright enforcement or searching in multimedia databases to metadata linking, audio and video synchronization, and the provision of many other added value services. Many of such applications rely on the comparison of an audio content captured by a microphone to a database of reference audio contents. Some of these applications are exemplified below.

Peters et al disclose in U.S. patent application Ser. No. 10/749,979 a method and apparatus for identifying ambient audio captured from a microphone and presenting to the user content associated with such identified audio. Similar methods are described in International Patent App. No. PCT/US2006/045551 (assigned to Google) for identifying ambient audio corresponding to a media broadcast, presenting personalized information to the user in response to the identified audio, and a number of other interactive applications.

U.S. patent application Ser. No. 09/734,949 (assigned to Shazam) describes a method and system for interacting with users, upon a user-provided sample related to his/her environment that is delivered to an interactive service in order to trigger events, with such sample including (but not limited to) a microphone capture.

U.S. patent application Ser. No. 11/866,814 (assigned to Shazam) describes a method for identifying a content captured from a data stream, which can be audio broadcast from a broadcast source such as a radio or TV station. The described method could be used for identifying a song within a radio broadcast.

Wang et al describe in U.S. patent application Ser. No. 10/831,945 a method for performing transactions, such as music purchases, upon the identification of a captured sound using, among others, a robust audio hashing method.

The use of robust hashing is also considered by R. Reisman in U.S. patent application Ser. No. 10/434,032 for interactive TV applications. Lu et al. consider in U.S. patent application Ser. No. 11/595,117 the use of robust audio hashes for performing audience measurements of broadcast programs.

Many techniques for performing audio identification exist. When one has the certainty that the audio to be identified and the reference audio exist in bit-by-bit exact copies, traditional cryptographic hashing techniques can be used to efficiently perform searches. However, if the audio copies differ a single bit, this approach fails. Other techniques for audio identification rely on attached meta-data, but they are not robust against format conversion, manual removal of the meta-data, D/A/D conversion, etc. When the audio can be slightly or severely distorted, other techniques which are sufficiently robust to such distortions must be used. Those techniques include watermarking and robust audio hashing. Watermarking-based techniques assume that the content to be identified conveys a certain code (watermark) that has been a priori embedded. However, watermark embedding is not always feasible, either for scalability reasons or other technological shortcomings. Moreover, if an unwatermarked copy of a given audio content is found, the watermark detector cannot extract any identification information from it. In contrast, robust audio hashing techniques do not need any kind of information embedding in the audio contents, thus rendering them more universal. Robust audio hashing techniques analyze the audio content in order to extract a robust descriptor, usually known as robust hash or fingerprint, that can be compared with other descriptors stored in databases.

Many robust audio hashing techniques exist. A review of the most popular existing algorithms can be found in the article by Cano et al. entitled "A review of audio fingerprinting", Journal of VLSI Signal Processing 41, 271-284, 2005. Some of the existing techniques are intended to identify complete songs or audio sequences, or even CDs or playlists. Other techniques are aimed to identify a song or an audio sequence using only a small fragment of it. Usually, the latter can be adapted to perform identification in streaming mode, i.e. capturing successive fragments from an audio stream and performing comparison with databases where the reference contents are not necessarily synchronized with those that have been captured. This is the most common operating mode for performing identification of broadcast audio and microphone-captured audio, in general.

Most methods for performing robust audio hashing divide the audio stream in contiguous blocks of short duration, usually with a significant degree of overlapping. For each of these blocks, a number of different operations are applied in order to extract distinctive features in such a way that they are robust to a given set of distortions. These operations include, on one hand, the application of signal transforms such as the Fast Fourier Transform (FFT), Modulated Complex Lapped Transform (MCLT), Discrete Wavelet Transform, Discrete Cosine Transform (DCT), Haar Transform or Walsh-Hadamard Transform, and others. Another processing which is common to most robust audio hashing methods is the separation of the transformed audio signals in sub-bands, emulating properties of the human auditory system, in order to extract perceptually meaningful parameters. A number of features can be extracted from the processed audio signals, namely Mel-Frequency Cepstrum Coefficients (MFCC), Spectral Flatness Measure (SFM), Spectral Correlation Function (SCF), the energy of the Fourier coefficients, the spectral centroids, the zero-crossing rate, etc. On the other hand, further common operations include frequency-time filtering to eliminate spurious channel effects and to increase decorrelation, and the use of dimensionality reduction techniques such as Principal Components Analysis (PCA), Independent Component Analysis (ICA), or the DCT.

A well known method for robust audio hashing that fits in the general description given above is described in the European patent No. 1362485 (assigned to Philips). The steps of this method can be summarized as follows: partitioning the audio signal in fixed-length overlapping windowed segments, computing the spectrogram coefficients of the audio signal using a 32-band filterbank in logarithmic frequency scale, performing a 2D filtering of the spectrogram coefficients, and quantizing the resulting coefficients with a binary quantizer according to its sign. Thus, the robust hash is composed of a binary sequence of 0s and 1s. The comparison of two robust hashes takes place by computing their Hamming distance. If such distance is below a certain threshold, then the two robust hashes are assumed to represent the same audio signal. This method provides reasonably good performance under mild distortions, but in general it is severely degraded under real-world working conditions. A significant number of subsequent works have added further processing or modified certain parts of the method in order to improve its robustness against different types of distortions.

The method described in EP1362485 is modified in the international patent application PCT/IB03/03658 (assigned to Philips) in order to gain resilience against changes in the reproduction speed of audio signals. In order to deal with the misalignments in the temporal and frequency domain caused by speed changes, the method introduces an additional step in the method described in EP1362485. This step consists in computing the temporal autocorrelation of the output coefficients of the filterbank, whose number of bands is also increased from 32 to 512. The autocorrelation coefficients can be optionally low-pass filtered in order to increase the robustness.

The article by Son et al. entitled "Sub-fingerprint Masking for a Robust Audio Fingerprinting System in a Real-noise Environment for Portable Consumer Devices", published in IEEE Transactions on Consumer Electronics, vol. 56, No. 1, February 2010, proposes an improvement over EP1362485 consistent on computing a mask for the robust hash, based on the estimation of the fundamental frequency components of the audio signal that generates the reference robust hash. This mask, which is intended to improve the robustness of the method disclosed in EP1362485 against noise, has the same length as the robust hash, and can take the values 0 or 1 in each position. For comparing two robust hashes, first they are element-by-element multiplied by the mask, and then their Hamming distance is compared as in EP1362485. Park et al. also pursue improved robustness against noise in the article "Frequency-temporal filtering for a robust audio fingerprinting scheme in real-noise environments", published in ETRI Journal, Vol. 28, No. 4, 2006. In such article the authors study the use of several linear filters for replacing the 2D filter used in EP1362485, keeping unaltered the remaining components.

Another well-known robust audio hashing method is described in the European patent No. 1307833 (assigned to Shazam). The disclosed method computes a series of "landmarks" or salient points (e.g. spectrogram peaks) of the audio recording, and it computes a robust hash for each landmark. In order to decrease the probability of false alarm, the landmarks are linked to other landmarks in their vicinity. Hence, each audio recording is characterized by a list of pairs [landmark, robust hash]. The method for comparison of audio signals consists of two steps. The first step compares the robust hashes of each landmark found in the query and reference audio, and for each match it stores a pair of corresponding time locations. The second step represents the pairs of time locations in a scatter plot, and a match between the two audio signals is declared if such scatter plot can be well approximated by a unit-slope line. U.S. Pat. No. 7,627,477 (assigned to Shazam) improves the method described in EP1307833, especially in what regards resistance against speed changes and efficiency in matching audio samples.

In some recent research articles, such as the article by Cotton and Ellis "Audio fingerprinting to identify multiple videos of an event" in IEEE International Conference on Acoustics, Speech and Signal Processing, 2010, and Umapathy et al. "Audio Signal Processing Using Time-Frequency Approaches: Coding, Classification, Fingerprinting, and Watermarking", in EURASIP Journal on Advances in Signal Processing, 2010, the proposed robust audio hashing methods decompose the audio signal in over-complete Gabor dictionaries in order to create a sparse representation of the audio signal.

The methods described in the patents and articles referenced above do not explicitly consider solutions to mitigate the distortions caused by multipath audio propagation and equalization, which are typical in microphone-captured audio identification, and which impair very seriously the identification performance if they are not taken into account. This kind of distortions has been considered in the design of other methods, which are reviewed below.

The international patent PCT/ES02/00312 (assigned to Universitat Pompeu-Fabra) discloses a robust audio hashing method for songs identification in broadcast audio, which regards the channel from the loudspeakers to the microphone as a convolutive channel. The method described in PCT/ES02/00312 transforms the spectral coefficients extracted from the audio signal to the logarithmic domain, with the aim of transforming the effect of the channel in an additive one. It then applies a high-pass linear filter in the temporal axis to the transformed coefficients, with the aim of removing the slow variations which are assumed to be caused by the convolutive channel. The descriptors extracted for composing the robust hash also include the energy variations as well as first and second order derivatives of the spectral coefficients. An important difference between this method and the methods referenced above is that, instead of quantizing the descriptors, the method described in PCT/ES02/00312 represents the descriptors by means of Hidden Markov Models (HMM). The HMMs are obtained by means of a training phase performed over a songs database. The comparison of robust hashes is done by means of the Viterbi algorithm. One of the drawbacks of this method is the fact that the log transform applied for removing the convolutive distortion transforms the additive noise in a non-linear fashion. This causes the identification performance to be rapidly degraded as the noise level of the audio capture is increased.

Other methods try to overcome the distortions caused by microphone capture resorting to techniques originally developed by the computer vision community, such as machine-learning. In the article "Computer vision for music identification", published in Computer Vision and Pattern Recognition, IEEE Computer Society Conference on Computer Vision and Pattern Recognition, Vol. 1, July 2005, Ke et al. generalize the method disclosed in EP1362485. Ke et al. extract from the music files a sequence of spectral sub-band energies that are arranged in a spectrogram; which is regarded as a digital image. The pairwise Adaboost technique is applied on a set of Viola-Jones features (simple 2D filters, that generalize the filter used in EP1362485) in order to learn the local descriptors and thresholds that best identify the musical fragments. The generated robust hash is a binary string, as in EP1362485, but the method for comparing robust hashes is much more complex, computing a likelihood measure according to an occlusion model estimated by means of the Expectation Maximization (EM) algorithm. Both the selected Viola-Jones features and the parameters of the EM model are computed in a training phase that requires pairs of clean and distorted audio signals. The resulting performance is highly dependent on the training phase, and also presumably on the mismatch between the training and capturing conditions. Furthermore, the complexity of the comparison method makes it not advisable for real time applications.

In the article "Boosted binary audio fingerprint based on spectral subband moments", published in IEEE International Conference on Acoustics, Speech and Signal Processing, vol. 1, pp. 241-244, April 2007, Kim and Yoo follow the same principles of the method proposed by Ke et al. Kim and Yoo also resort to the Adaboost technique, but using normalized spectral sub-band moments instead of spectral sub-band energies.

U.S. patent App. No. 60/823,881 (assigned to Google) also discloses a method for robust audio hashing based on techniques commonly used in the field of computer vision, inspired by the insights provided by Ke et al. However, instead of applying Adaboost this method applies 2D wavelet analysis on the audio spectrogram, which is regarded as a digital image. The wavelet transform of the spectrogram is computed, and only a limited number of meaningful coefficients is kept. The coefficients of the computed wavelets are quantized according to their sign, and the Min-Hash technique is applied in order to reduce the dimensionality of the final robust hash. The comparison of robust hashes takes place by means of the Locality-Sensitive-Hashing technique in order for the comparison to be efficient in large databases, and dynamic-time warping in order to increase robustness against temporal misalignments.

Other methods try to increase the robustness against frequency distortions by applying some normalization to the spectral coefficients. The paper by Sukittanon and Atlas, "Modulation frequency features for audio fingerprinting", presented in IEEE International Conference of Acoustics, Speech and Signal Processing, May 2002, is based on modulation frequency analysis in order to characterize the time-varying behavior of the audio signal. A given audio signal is first decomposed in a set of frequency sub-bands, and the modulation frequency of each sub-band is estimated by means of a wavelet analysis at different time scales. At this point, the robust hash of an audio signal consists in a set modulation frequency features at different time scales in each sub-band. Finally, for each frequency sub-band, the modulation frequency features are normalized by scaling them uniformly by the sum of all the modulation frequency values computed for a given audio fragment. This approach has several drawbacks. On one hand, it assumes that the distortion is constant throughout the duration of the whole audio fragment. Thus, variations in the equalization or volume that occur in the middle of the analyzed fragment will negatively impact its performance. On the other hand, in order to perform the normalization it is necessary to wait until a whole audio fragment is received and its features extracted. These, drawbacks make the method not advisable for real-time or streaming applications.

U.S. Pat. No. 7,328,153 (assigned to Gracenote) describes a method for robust audio hashing that decomposes windowed segments of the audio signals in a set of spectral bands. A time-frequency matrix is constructed wherein each element is computed from a set of audio features in each of the spectral bands. The used audio features are either DCT coefficients or wavelet coefficients for a set of wavelet scales. The normalization approach is very similar to that in the method described by Sukittanon and Atlas: in order to improve the robustness against frequency equalization, the elements of the time-frequency matrix are normalized in each band by the mean power value in such band. The same normalization approach is described in U.S. patent application Ser. No. 10/931,635.

In order to further improve the robustness against distortions, many robust audio hashing methods apply in their final steps a quantizer to the extracted features. Quantized features are also beneficial for simplifying hardware implementations and reducing memory requirements. Usually, these quantizers are simple binary scalar quantizers although vector quantizers, Gaussian Mixture Models and Hidden Markov Models are also described in the previous art.

In general, and in particular when scalar quantizers are used, the quantizers are not optimally designed in order to maximize the identification performance of the robust hashing methods. Furthermore, for computational reasons, scalar quantizers are usually preferred since vector quantization is highly time-consuming, especially when the quantizer is non-structured. The use of multilevel quantizers (i.e. with more than two quantization cells) is desirable for increasing the discriminability of the robust hash. However, multilevel quantization is particularly sensitive to distortions such as frequency equalization, multipath propagation and volume changes, which occur in scenarios of microphone-captured audio identification. Hence, multilevel quantizers cannot be applied in such scenarios unless the hashing method is robust by construction to those distortions. A few works describe scalar quantization methods adapted to the input signal.

U.S. patent application Ser. No. 10/994,498 (assigned to Microsoft) describes a robust audio hashing method that performs computation of first order statistics of MCLT-transformed audio segments, performs an intermediate quantization step using an adaptive N-level quantizer that is obtained from the histogram of the signals, and finally quantizes the result using an error correcting decoder, which is a form of vector quantizer. In addition, it considers a randomization for the quantizer depending on a secret key.

Allamanche et al. describe in U.S. patent application Ser. No. 10/931,635 a method that also uses a scalar quantizer adapted to the input signal. In one embodiment, the quantization step is a function of the magnitude of the input values: it is larger for large values and smaller for small values. In another embodiment, the quantization steps are set in order to keep the quantization error within a predefined range of values. In yet another embodiment, the quantization step is larger for values of the input signal occurring with small relative frequency, and smaller for values of the input signal occurring with higher frequency.

The main drawback of the methods described in U.S. patent application Ser. No. 10/931,635 and U.S. patent application Ser. No. 10/994,498 is that the optimized quantizer is always dependent on the input signal, making it suitable only for coping with mild distortions. Any moderate or severe distortion will likely cause the quantized features to be significantly different for the test audio and the reference audio, thus increasing the probability of missing correct audio matches.

As it has been explained, the existing robust audio hashing methods still present numerous deficiencies that make them not suitable for real time identification of streaming audio captured with microphones. In this scenario, a robust audio hashing scheme must fulfill several requirements:

- Computational efficiency in the robust hash generation. In many cases, the task of computing the robust audio hashes must be carried out in electronic devices performing a number of different simultaneous tasks and with small computational power (e.g. a user laptop, a mobile device or an embedded device). Hence, keeping a small computational complexity in the robust hash computation is of high interest.
- Computational efficiency in the robust hash comparison. In some cases, the robust hash comparison must be run on big databases, thus demanding for efficient search and match algorithms. A significant number of methods fulfilling this characteristic exist. However, there is another related scenario which is not well addressed in the prior art: a large number of users concurrently performing queries to a server, where the size of the reference database is not necessarily large. This is the case, for instance, robust-hash-based audience measurement for broadcast transmissions, or in robust-hash-based interactive services, where both the number of users and the amount of queries per second to the server can be very high. In this case, the emphasis in efficiency must be put in the comparison method rather than in the search method. Therefore, this latter scenario places the requirement that the robust hash comparison must be as simple as possible, in order to minimize the number of comparison operations.

High robustness to microphone-capture channels. When capturing streaming audio with microphones, the audio is subject to distortions like echo addition (due to multipath propagation of the audio), equalization and ambient noise. Moreover, the capturing device, for instance a microphone embedded in an electronic device, such as a cell phone or a laptop, introduces more additive noise and possibly nonlinear distortions. Hence, the expected Signal to Noise Ratio (SNR) in this kind of applications is very low (usually in the order of 0 dBs or even smaller). One of the main difficulties is to find a robust hashing method which is highly robust to multipath and equalization and whose performance does not dramatically degrade for low SNRs. As it has been seen, none of the existing robust hashing methods are able to completely fulfill this requirement.

Reliability. Reliability is measured in terms of probability of false positive ($P_{FP}$) and miss-detection ($P_{MD}$). $P_{FP}$ measures the probability that a sample audio content is incorrectly identified, i.e. it is matched with another audio content which is not related to the sample audio. If $P_{FP}$ is high, then the robust audio hashing scheme is said to be not sufficiently discriminative. $P_{MD}$ measures the probability that the robust hash extracted from a sample audio content does not find any correspondence in the database of reference robust hashes, even when such correspondence exists. When $P_{MD}$ is high, the robust audio hashing scheme is said to be not sufficiently robust. While it is desirable to keep $P_{MD}$ as low as possible, the cost of false positives is in general much higher than that of miss-detections. Thus, for most applications it is preferable to keep the probability of false alarm very low, being acceptable to have a moderately high probability of miss-detection.

DESCRIPTION OF THE INVENTION

The present invention describes a method for performing identification of audio based on a robust hashing. The core of the present invention is a normalization method that makes the features extracted from the audio signals approximately invariant to the distortions caused by microphone-capture channels. The invention is applicable to numerous audio identification scenarios, but it is particularly suited to identification of microphone-captured or linearly filtered streaming audio signals in real time, for applications such as audience measurement or providing interactivity to users.

The present invention overcomes the problems identified in the review of the related art for fast and reliable identification of captured streaming audio in real time, providing a high degree of robustness to the distortions caused by the microphone-capture channel. The present invention extracts from the audio signals a sequence of feature vectors which is highly robust, by construction, against multipath audio propagation, frequency equalization and extremely low signal to noise ratios.

The present invention comprises a method for computing robust hashes from audio signals, and a method for comparing robust hashes. The method for robust hash computation is composed of three main blocks: transform, normalization, and quantization. The transform block encompasses a wide variety of signal transforms and dimensionality reduction techniques. The normalization is specially designed to cope with the distortions of the microphone-capture channel, whereas the quantization is aimed at providing a high degree of discriminability and compactness to the robust hash. The method for robust hash comparison is very simple yet effective.

The main advantages of the method disclosed herein are the following:

- The computation of the robust hash is very simple, allowing for lightweight implementations in devices with limited resources.
- The features extracted from the audio signals can be normalized on the fly, without the need to wait for large audio fragments. Thus, the method is suited to streaming audio identification and real time applications.
- The method can accommodate temporal variations in the channel distortion, making it very suitable to streaming audio identification.
- The robust hashes are very compact, and the comparison method is very simple, allowing for server-client architectures in large scale scenarios.
- High identification performance: the robust hashes are both highly discriminative and highly robust, even for short lengths.

In accordance with one aspect of the present invention there is provided a method for audio content identification based on robust audio hashing, comprising:

a robust hash extraction step wherein a robust hash is extracted from audio content, said step comprising in turn:

- dividing the audio content in at least one frame, preferably in a plurality T of overlapping frames;
- applying a transformation procedure on said at least one frame to compute, for each frame, at least one transformed coefficient;
- applying a normalization procedure on the at least one transformed coefficient to obtain at least one normalized coefficient, wherein said normalization procedure comprises computing the product of the sign of each coefficient of said at least one transformed coefficient by an amplitude-scaling-invariant function of any combination of said at least one transformed coefficient;
- applying a quantization procedure on said at least one normalized coefficient to obtain the robust hash of the audio content; and a comparison step wherein the robust hash is compared with at least one reference hash to find a match;

In a preferred embodiment the method further comprises a preprocessing step wherein the audio content is firstly processed to provide a preprocessed audio content in a format suitable for the robust hash extraction step. The preprocessing step may include any of the following operations:

- conversion to Pulse Code Modulation (PCM) format;
- conversion to a single channel in case of multichannel audio;
- conversion of the sampling rate.

The robust hash extraction step preferably comprises a windowing procedure to convert the at least one frame into at least one windowed frame for the transformation procedure.

In yet another preferred embodiment the robust hash extraction step further comprises a postprocessing procedure to convert the at least one normalized coefficient into at least one postprocessed coefficient for the quantization procedure. The postprocessing procedure may include at least one of the following operations:

filtering out other distortions;

smoothing the variations in the at least one normalized coefficient;

reducing the dimensionality of the at least one normalized coefficient.

The normalization procedure is preferably applied on at least one transformed coefficient arranged in a matrix of size EXT to obtain a matrix of normalized coefficients of size F'×T', with F'=F, T'≤T, whose elements Y(f', t') are computed according to the following rule:

$$Y(f', t') = \frac{\text{sign}(X(f', M(t'))) \times H(X_{f'})}{G(X_{f'})},$$

where X(f', M(t')) are the elements of the matrix of transformed coefficients, $X_{f'}$ is the fth row of the matrix of transformed coefficients, M( ) is a function that maps indices from {1, . . . , T'} to {1, . . . , T}, and both H( ) and G( ) are homogeneous functions of the same order.

Functions H( ) and G( ) may be obtained from linear combinations of homogeneous functions. Functions H( ) and G( ) may be such that the sets of elements of $X_f$ used in the numerator and denominator are disjoint, or such that the sets of elements of $X_f$ used in the numerator and denominator are disjoint and correlative. In a preferred embodiment homogeneous functions H( ) and G( ) are such that:

$$H(X_{f'})=H(\overline{X}_{f',M(t')}),\ G(X_{f'})=G(\underline{X}_{f',M(t')}),$$

with $$\overline{X}_{f',M(t')}=[X(f',M(t')),X(f',M(t')+1), \ldots ,X(f',k_u)],$$

$$\underline{X}_{f',M(t')}=[X(f',k_l), \ldots ,X(f',M(t')-2), \ldots ,X(f',M(t')-1],$$

where $k_l$ is the maximum of $\{M(t')-L_l,1\}$, $k_u$ is the minimum of $\{M(t')+L_u-1,T\}$, M(t')>1, and $L_l>1$, $L_u>0$.

Preferably, M(t')=t'+1 and $H(\overline{X}_{f',M(t')})=\text{abs}(X(f',t'+1))$, resulting in the following normalization rule:

$$Y(f', t') = \frac{X(f', t'+1)}{G(\underline{X}_{f',t'+1})},$$

In a preferred embodiment, G( ) is chosen such that $$G(\underline{X}_{f',t'+1}) = L^{-\frac{1}{p}} \times (a(1) \times |X(f', t')|^p + a(2) \times |X(f', t'-1)|^p + \ldots + a(L) \times |X(f', t'-L+1)|^p)^{\frac{1}{p}},$$

where $L_l$=L, a=[a($1_1$, a(2), . . . , a(L)] is a weighting vector and p is a positive real number.

In yet another preferred embodiment the normalization procedure may be applied on the at least one transformed coefficient arranged in a matrix of size F×T to obtain a matrix of normalized coefficients of size F'×T', with F'≤T'=T, whose elements Y(f', t') are computed according to the following rule:

$$Y(f', t') = \frac{\text{sign}(X(M(f'), t')) \times H(X_{t'})}{G(X_{t'})},$$

where X(M(f'), t') are the elements of the matrix of transformed coefficients, $X_{t'}$ is the t'th column of the matrix of transformed coefficients, M( ) is a function that maps indices from {1, . . . , F'} to {1, . . . , F}, and both H( ) and G( ) are homogeneous functions of the same order.

For performing the normalization a buffer may be used to store a matrix of past transformed coefficients of audio contents previously processed.

The transformation procedure may comprise a spectral subband decomposition of each frame. The transformation procedure preferably comprises a linear transformation to reduce the number of the transformed coefficients. The transformation procedure may further comprise dividing the spectrum in at least one spectral band and computing each transformed coefficient as the energy of the corresponding frame in the corresponding spectral band.

In the quantization procedure at least one multilevel quantizer obtained by a training method may be employed. The training method for obtaining the at least one multilevel quantizer preferably comprises:

computing partition, obtaining Q disjoint quantization intervals by maximizing a predefined cost function which depend on the statistics of a plurality of normalized coefficients computed from a training set of training audio fragments; and computing symbols, associating one symbol to each interval computed.

In the training method for obtaining the at least one multilevel quantizer the coefficients computed from a training set are preferably arranged in a matrix and one quantizer is optimized for each row of said matrix.

The symbols may be computed according to any of the following ways:

computing the centroid that minimizes the average distortion for each quantization interval;

assigning to each partition interval a fixed value according to a Pulse Amplitude Modulation of Q levels.

In a preferred embodiment the cost function is the empirical entropy of the quantized coefficients, computed according to the following formula:

$$Ent(\overline{P}_f) = -\sum_{i=1}^{Q} (N_{i,f} / L_c)\log(N_{i,f} / L_c),$$

where $N_{i,f}$ is the number of coefficients of the fth row of the matrix of postprocessed coefficients assigned to the ith interval of the partition, and $L_c$ is the length of each row.

A similarity measure, preferably the normalized correlation, may be employed in the comparison step between the robust hash and the at least one reference hash. The comparison step preferably comprises, for each reference hash:

extracting from the corresponding reference hash at least one sub-hash with the same length J as the length of the robust hash;

converting the robust hash and each of said at least one sub-hash into the corresponding reconstruction symbols given by the quantizer;

computing a similarity measure according to the normalized correlation between the robust hash and each of said at least one sub-hash according to the following rule:

$$C = \frac{\sum_{i=1}^{J} h_q(i) \times h_r(i)}{\text{norm}_2(h_q) \times \text{norm}_2(h_r)},$$

where $h_q$ represents the query hash of length J, $h_r$ a reference sub-hash of the same length J, and where $$\text{norm}_2(h) = \left(\sum_{i=1}^{J} h(i)^2\right)^{\frac{1}{2}}.;$$

comparing a function of said at least one similarity measure against a predefined threshold;

deciding, based on said comparison, whether the robust hash and the reference hash represent the same audio content.

In accordance with a further aspect of the present invention there is provided a robust hash' extraction method for audio content identification, wherein a robust hash is extracted from audio content, the robust hash extraction method comprising:

dividing the audio content in at least one frame;

applying a transformation procedure on said at least one frame to compute, for each frame, at least one transformed coefficient;

applying a normalization procedure on the at least one transformed coefficient to obtain at least one normalized coefficient, wherein said normalization procedure comprises computing the product of the sign of each coefficient of said at least one transformed coefficient by an amplitude-scaling-invariant function of any combination of said at least one transformed coefficient;

applying a quantization procedure on said at least one normalized coefficient to obtain the robust hash of the audio content.

Another aspect of the present invention is to provide a method for deciding whether two robust hashes computed according to the previous robust hash extraction method represent the same audio content. Said method comprises:

extracting from the longest hash at least one sub-hash with the same length J as the length of the shortest hash;

converting the shortest hash and each of said at least one sub-hash into the corresponding reconstruction symbols given by the quantizer;

computing a similarity measure according to the normalized correlation between the shortest hash and each of said at least one sub-hash according to the following rule:

$$C = \frac{\sum_{i=1}^{J} h_q(i) \times h_r(i)}{\text{norm}_2(h_q) \times \text{norm}_2(h_r)},$$

where $h_q$ represents the query hash of length J, $h_r$ a reference sub-hash of the same length J, and where $$\text{norm}_2(h) = \left(\sum_{i=1}^{J} h(i)^2\right)^{\frac{1}{2}}.;$$

comparing a function (preferably the maximum) of said at least one similarity measure against a predefined threshold;

deciding, based on said comparison, whether the two robust hashes represent the same audio content.

In accordance with yet another aspect of the present invention there is provided a system for audio content identification based on robust audio hashing, comprising:

a robust hash extraction module for extracting a robust hash from audio content, said module comprising processing means configured for:

dividing the audio content in at least one frame;

applying a transformation procedure on said at least one frame to compute, for each frame, at least one transformed coefficient;

applying a normalization procedure on the at least one transformed coefficient to obtain at least one normalized coefficient, wherein said normalization procedure comprises computing the product of the sign of each coefficient of said at least one transformed coefficient by an amplitude-scaling-invariant function of any combination of said at least one transformed coefficient;

applying a quantization procedure on said at least one normalized coefficient to obtain the robust hash of the audio content.

a comparison module for comparing the robust hash with at least one reference hash to find a match.

Another aspect of the present invention is a robust hash extraction system for audio content identification, aimed to extract a robust hash from audio content. The robust hash extraction system comprises processing means configured for:

dividing the audio content in at least one frame;

applying a transformation procedure on said at least one frame to compute, for each frame, at least one transformed coefficient;

applying a normalization procedure on the at least one transformed coefficient to obtain at least one normalized coefficient, wherein said normalization procedure comprises computing the product of the sign of each coefficient of said at least one transformed coefficient by an amplitude-scaling-invariant function of any combination of said at least one transformed coefficient;

applying a quantization procedure on said at least one normalized coefficient to obtain the robust hash of the audio content.

A yet another aspect of the present invention is a system for deciding whether two robust hashes computed by the previous robust hash extraction system represent the same audio content. Said system comprises processing means configured for:

extracting from the longest hash at least one sub-hash with the same length J as the length of the shortest hash;

converting the shortest hash and each of said at least one sub-hash into the corresponding reconstruction symbols given by the quantizer;

computing a similarity measure according to the normalized correlation between the shortest hash and each of said at least one sub-hash according to the following rule:

$$C = \frac{\sum_{i=1}^{J} h_q(i) \times h_r(i)}{\text{norm}_2(h_q) \times \text{norm}_2(h_r)},$$

where $h_q$ represents the query hash of length J, $h_r$ a reference sub-hash of the same length J, and where $$\text{norm}_2(h) = \left(\sum_{i=1}^{J} h(i)^2\right)^{\frac{1}{2}}.;$$

comparing a function of said at least one similarity measure against a predefined threshold;

deciding, based on said comparison, whether the two robust hashes represent the same audio content.

BRIEF DESCRIPTION OF THE DRAWINGS

A series of drawings which aid in better understanding the invention and which are expressly related with an embodiment of said invention, presented as a non-limiting example thereof, are very briefly described below.

DESCRIPTION OF A PREFERRED EMBODIMENT OF THE INVENTION

Figure 1:
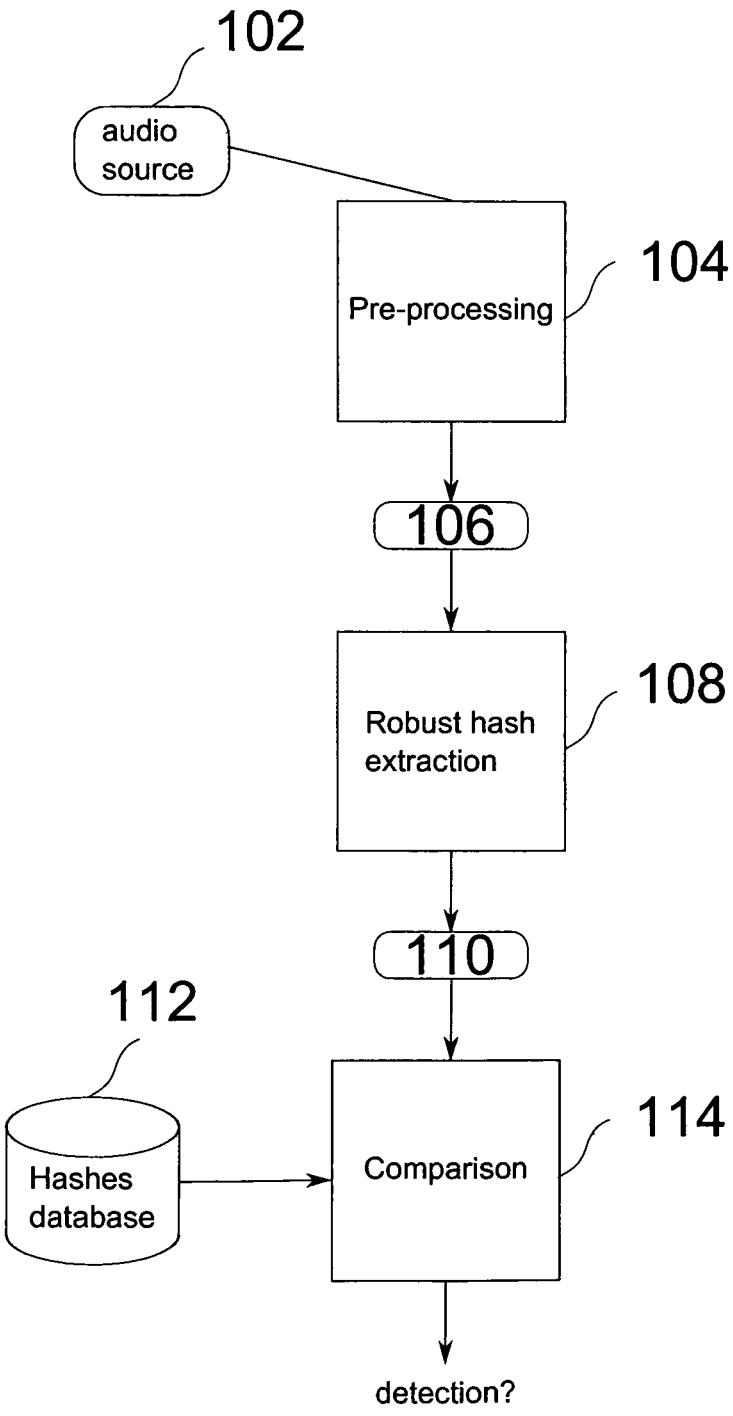
FIG. 1 depicts a schematic block diagram of a robust hashing system according to the present invention.

FIG. 1 depicts the general block diagram of an audio identification system based on robust audio hashing according to the present invention. The audio content 102 can be originated from any source: it can be a fragment extracted from an audio file retrieved from any storage system, a microphone capture from a broadcast transmission (radio or TV, for instance), etc. The audio content 102 is preprocessed by a preprocessing module 104 in order to provide a preprocessed audio content 106 in a format that can be fed to the robust hash extraction module 108. The operations performed by the preprocessing module 104 include the following: conversion to Pulse Code Modulation (PCM) format; conversion to a single channel in case of multichannel audio, and conversion of the sampling rate if necessary. The robust hash extraction module 108 analyzes the preprocessed audio content 106 to extract the robust hash 110, which is a vector of distinctive features that are used by the comparison module 114 to find possible matches. The comparison module 114 compares the robust hash 110 with the reference hashes stored in a hashes database 112 to find possible matches.

Figure 2:
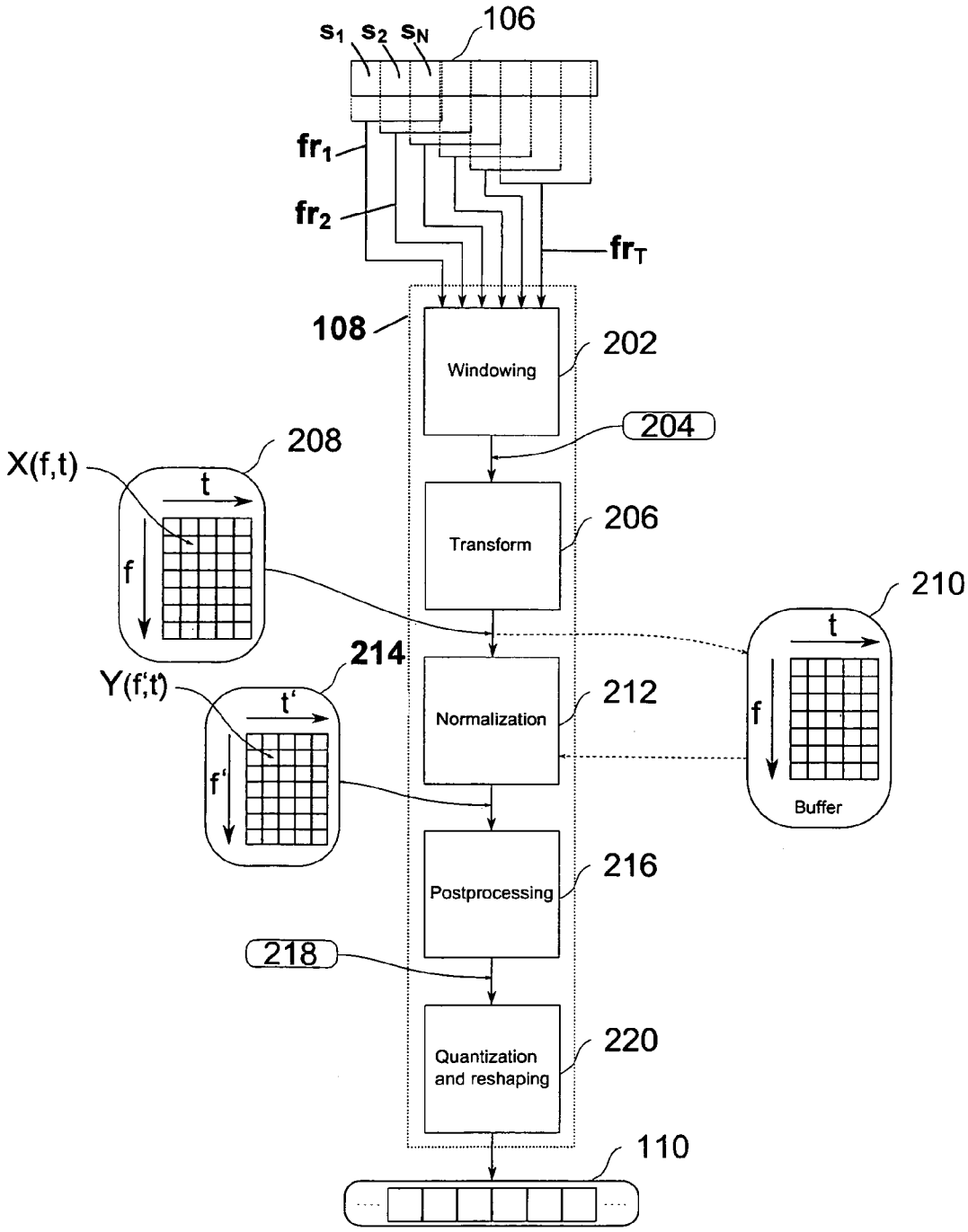
FIG. 2 is a block diagram representing the method for computing a robust hash from a sample audio content.

In a first embodiment, the invention performs identification of a given audio content by extracting from such audio content a feature vector which can be compared against other reference robust hashes stored in a given database. In order to perform such identification, the audio content is processed according to the method shown in FIG. 2. The preprocessed audio content 106 is first divided in overlapping frames $\{fr_t\}$, with $1 \le t \le T$, of size N samples $\{s_n\}$. with $1 \le n \le N$. The degree of overlapping must be significant, in order to make the hash robust to temporal misalignments. The total number of frames, T, will depend on the length of the preprocessed audio content 106 and the degree of overlapping. As is common in audio processing, each frame is multiplied by a predefined window—windowing procedure 202 (e.g. Hamming, Hanning, Blackman, etc.)—, in order to reduce the effects of framing in the frequency domain.

In the next step, the windowed frames 204 undergo a transformation procedure 206 that transforms such frames into a matrix of transformed coefficients 208 of size F×T. More specifically, a vector of F transformed coefficients is computed for each frame and they are arranged as column vectors. Hence, the column of the matrix of transformed coefficients 208 with index t, with $1 \le t \le T$, contains all transformed coefficients for the frame with the same temporal index. Similarly, the row with index f, with $1 \le f \le F$, contains the temporal evolution of the transformed coefficient with the same index f. The computation of the elements X(f,t) of the matrix of transformed coefficients 208 shall be explained below. Optionally, the matrix of transformed coefficients 208 may be stored as a whole or in part in a buffer 210. The usefulness of such buffer 210 shall be illustrated below during the description of another embodiment of the present invention.

The elements of the matrix of transformed coefficients 208 undergo a normalization procedure 212 which is key to ensure the good performance of the present invention. The normalization considered in this invention is aimed at creating a matrix of normalized coefficients 214 of size F'×T', where $F' \le F, T' \le T$, with elements Y(f',t'), more robust to the distortions caused by microphone-capture channels. The most important distortion in microphone-capture channels comes from the multipath propagation of the audio, which introduces echoes, thus producing severe distortions in the captured audio.

In addition, the matrix of normalized coefficients 214 is input to a postprocessing procedure 216 that could be aimed, for instance, at filtering out other distortions, smoothing the variations in the matrix of normalized coefficients 214, or reducing its dimensionality using Principal Component Analysis (PCA), Independent Component Analysis (ICA), the Discrete Cosine Transform (DCT), etc. The resulting postprocessed coefficients are arranged in a matrix of postprocessed coefficients 218, although possibly of a smaller size than the matrix of normalized coefficients 214.

Finally, the postprocessed coefficients 218 undergo a quantization procedure 220. The objective of the quantization is two-fold: to make the hash more compact and to increase the robustness against noise. For the reasons explained before, the quantizer is preferred to be scalar, i.e. it quantizes each coefficient independently of the others. Contrary to most quantizers used in existing robust hashing methods, the quantizer used in this invention is not necessarily binary. Indeed, the best performance of the present invention is obtained using a multilevel quantizer, which makes the hash more discriminative. As explained before, one condition for the effectiveness of such multilevel quantizer is that its input must be (at least approximately) invariant to distortions caused by multipath propagation. Hence, the normalization 212 is key to guaranteeing the good performance of the invention.

The normalization procedure 212 is applied on the transformed coefficients 208 to obtain a matrix of normalized coefficients 214, which in general is of size F'×T'. The normalization 212 comprises computing the product of the sign of each coefficient of said matrix of transformed coefficients 208 by an amplitude-scaling-invariant function of any combination of said matrix of transformed coefficients (208).

In a preferred embodiment, the normalization 212 produces a matrix of normalized coefficients 214 of size F'×T', with F'=F,T'≤T, whose elements are computed according to the following rule:

$$Y(f', t') = \frac{\text{sign}(X(f', M(t'))) \times H(X_{f'})}{G(X_{f'})}, \tag{1}$$

where $X_{f'}$ is the f'th row of the matrix of transformed coefficients 208, M( ) is a function that maps indices from {1, . . . , T'} to {1, . . . T}, i.e. it deals with changes on frame indices due to the possible reduction in the number of frames, and both H( ) and G( ) are homogeneous functions of the same order. A homogeneous function of order n is a function which, for any positive number ρ, fulfills the following relation:

$$G(\rho X_{f'}) = \rho^n G(X_{f'}). \tag{2}$$

The objective of the normalization is to make the coefficients Y(f',t') invariant to scaling. This invariance property greatly improves the robustness to distortions such as multipath audio propagation and frequency equalization. According to equation (1), the normalization of the element X(f,t) only uses elements of the same row f of the matrix of transformed coefficients 208. However, this embodiment should not be taken as limiting, because in a more general setting the normalization 212 could use any element of the whole matrix 208, as will be explained below.

There exist numerous embodiments of the normalization that are suited to the purposes sought. In any case, the functions H( ) and G( ) must be appropriately chosen so that the normalization is effective. One possible choice is to make the sets of elements of $X_{f'}$ used in the numerator and denominator disjoint. There exist multiple combinations of elements that fulfill this condition. Just one of them is given by the following choice:

$$H(X_{f'}) = H(\overline{X}_{f',M(t')}),\ G(X_{f'}) = G(\underline{X}_{f',M(t')}), \tag{3}$$

with $$\overline{X}_{f',M(t')} = [X(f',M(t')), X(f',M(t')+1), \ldots, X(f',k_u)], \tag{4}$$

$$\underline{X}_{f',M(t')} = [X(f',k_l), \ldots, X(f',M(t')-2), \ldots, X(f',M(t')-1], \tag{5}$$

where k, is the maximum of $\{M(t')-L_l, 1\}$, $k_u$ is the minimum of $\{M(t')+L_u-1, T\}$, M(t')>1, and $L_l>1$, $L_u>0$. With this choice, at most $L_u$ elements of $X_{f'}$ are used in the numerator of (1), and at most $L_l$ elements of $X_{f'}$ are used in the denominator. Furthermore, not only the sets of coefficients used in the numerator and denominator are disjoint, but they are correlative. Another fundamental advantage of the normalization using these sets of coefficients is that it adapts dynamically to temporal variations in the microphone-capture channel, since the normalization only takes into account the coefficients in a sliding window of length $L_l+L_u$.

Figure 4:
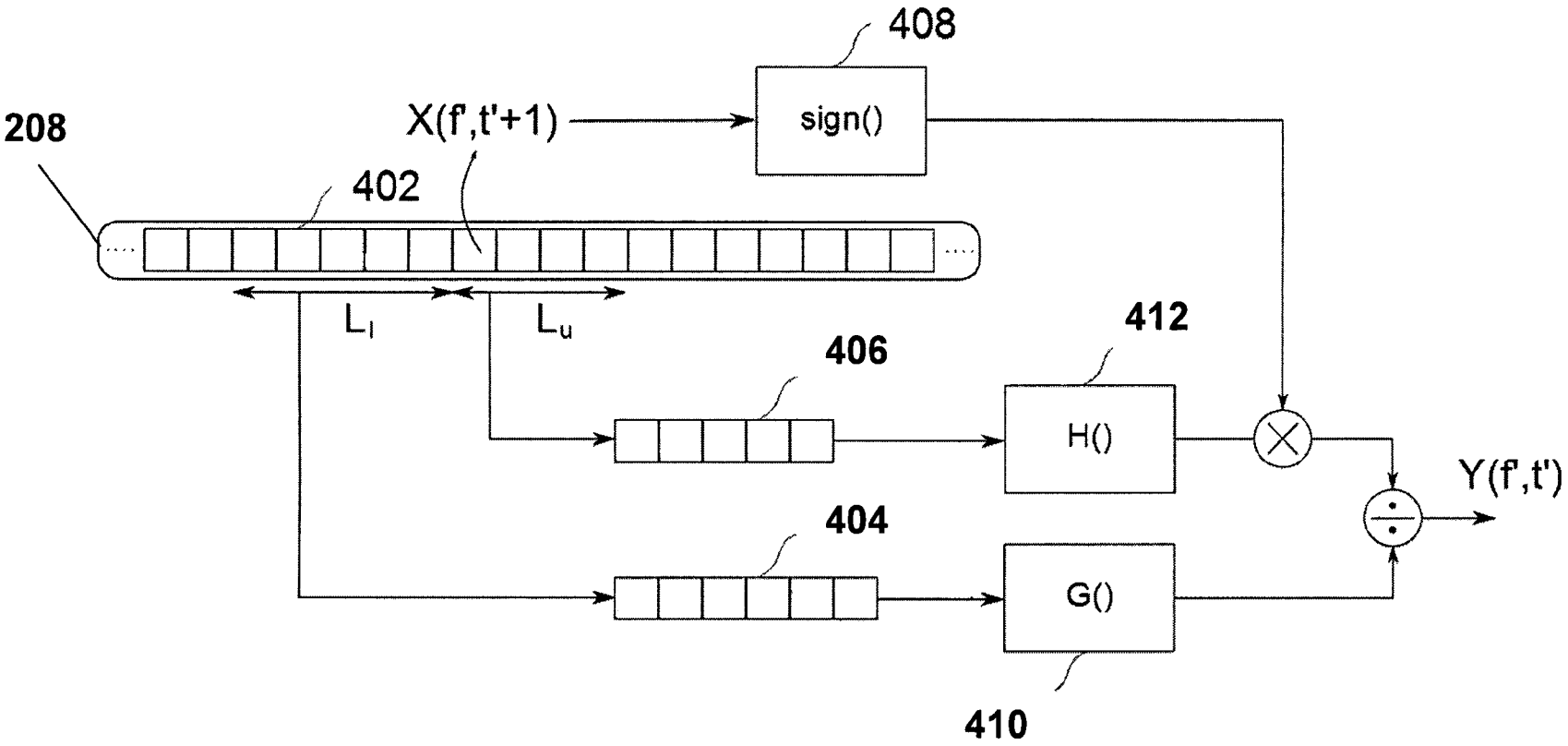
FIG. 4 is a block diagram representing the normalization method.

FIG. 4 shows a block diagram of the normalization according to this embodiment, where the mapping function has been fixed to M(t')=t'+1. A buffer of past coefficients 404 stores the $L_l$ elements of the jth row 402 of matrix of transformed coefficients 208 from X(f',t'+1−$L_l$) to X(f',t'), and they are input to the G( ) function 410. Similarly, a buffer of future coefficients 406 stores the $L_u$ elements from X(f',t'+1) to X(f',t'+$L_u$) and they are input to the H( ) function 412. The output of the H( ) function is multiplied by the sign of the current coefficient X(f',t'+1) computed in 408. The resulting number is finally divided by the output of the G( ) function 412, yielding the normalized coefficient Y(f',t').

If the functions H( ) and G( ) are appropriately chosen, as $L_l$ and Lu are increased the variation of the coefficients Y(f',t') can be made smoother, thus increasing the robustness to noise, which is another objective pursued by the present invention. The drawback of increasing $L_l$ and $L_u$ is that the time to get adapted to the changes in the channel increases as well. Hence, a tradeoff between adaptation time and robustness to noise exists. The optimal values of $L_l$ and $L_u$ depend on the expected SNR and the variation speed of the microphone-capture channel.

A specific case of the normalization, equation (1), that is particularly useful for streaming applications is obtained by fixing H($\overline{X}_{f',M(t')}$)=abs(X(f',t'+1)), yielding $$Y(f', t') = \frac{X(f', t'+1)}{G(\underline{X}_{f',t'+1})}, \tag{6}$$

with $L_l$=L. Hence, the normalization makes the coefficient Y(f',t') dependent on at most L past audio frames. Here, the denominator G($\underline{X}_{f',t'+1}$) can be regarded as a sort of normalization factor. As L is increased, the normalization factor varies more smoothly, increasing as well the time to get adapted to the changes in the channel. The embodiment of equation (6) is particularly suited to real time applications, since it can be easily performed on the fly as the frames of the audio fragment are processed, without the need of waiting for the processing of the whole fragment or future frames.

One particular family of order-1 homogeneous functions which is appropriate for practical embodiments is the family of weighted p-norms, which is exemplified here for G($\underline{X}_{f',t'+1}$):

$$G(\underline{X}_{f',t'+1}) = L^{-\frac{1}{p}} \times (a(1) \times |X(f', t')|^p + a(2) \times |X(f', t'-1)|^p + \ldots + a(L) \times |X(f', t'-L+1)|^p)^{\frac{1}{p}}, \tag{7}$$

where a=[a(1), a(2), a(L)] is the weighting vector, and p can take any positive value (not necessarily an integer). The parameter p can be tuned to optimize the robustness of the robust hashing system. The weighting vector can be used to weight the coefficients of the vector $\underline{X}_{f',t'+1}$ according for instance to a given reliability metric, such as their amplitude (coefficients with smaller amplitude could have less weight in the normalization, because they are deemed unreliable). Another use of the weighting vector is to implement an online forgetting factor. For instance, if a=[γ, $\gamma^2$, $\gamma^3$, . . . , $\gamma^L$], with |γ|<1, then the weight of the coefficients in the normalization window decays exponentially as they get farther in time. The forgetting factor can be used to increase the length of the normalization window without slowing too much the adaptation to changes in the microphone-capture channel.

In yet another embodiment, the functions H( ) and G( ) are obtained from linear combinations of homogeneous functions. An example made up of the combination of weighted p-norms is shown here for the G( ) function:

$$G(\underline{X}_{f,t})=w_1\times G_1(\underline{X}_{f,t})+w_2\times G_2(\underline{X}_{f,t}), \tag{8}$$

where $$G_1(\underline{X}_{f,t}) = L^{-\frac{1}{p_1}}\times(a_1(1)\times|X(f,t-1)|^{p_1}+a_1(2)\times|X(f,t-2)|^{p_1}+\ldots+a_1(L)\times|X(f,t-L)|^{p_1})^{\frac{1}{p_1}}, \tag{9}$$

$$G_2(\underline{X}_{f,t}) = L^{-\frac{1}{p_2}}\times(a_2(1)\times|X(f,t-1)|^{p_2}+a_2(2)\times|X(f,t-2)|^{p_2}+\ldots+a_2(L)\times|X(f,t-L)|^{p_2})^{\frac{1}{p_2}}, \tag{10}$$

where $w_1$ and $w_2$ are weighting factors. In this case, the elements of the weighting vectors $a_1$ and $a_2$ only take values 0 or 1, in such a way that $a_1+a_2=[1, 1, \ldots, 1]$. This is equivalent to partitioning the coefficients of $\underline{X}_{f,t}$ in two disjoint sets, according to the indices of $a_1$ and $a_2$ which are set to 1. If $p_1<p_2$, then the coefficients indexed by $a_1$ have less influence in the normalization. This feature is useful for reducing the negative impact of unreliable coefficients, such as those with small amplitudes. The optimal values for the parameters $w_1$, $w_2$, $p_1$, $p_2$, $a_1$ and $a_2$ can be sought by means of standard optimization techniques.

All the embodiments of the normalization 212 that have been described above stick to the equation (1), i.e. the normalization takes place along the rows of the matrix of transformed coefficients 208. In yet another embodiment, the normalization is performed columnwise to yield a matrix of normalized coefficients of size F'×T', with F'≤F, T'32 T. Similarly to equation (1), the normalized elements are computed as:

$$Y(f',t')=\frac{\mathrm{sign}(X(M(f'),t'))\times H(X_{t'})}{G(X_{t'})},$$

where $X_{t'}$ is the t'th column of the matrix of transformed coefficients 208, M( ) is function that maps indices from {1, . . . , F'} to {1, . . . , F}, i.e. it deals with changes on transformed coefficient indices due to the possible reduction in the number of transformed coefficients per frame, and both H( ) and G( ) are homogeneous functions of the same order. One case where the application of this normalization is particularly useful is when the audio content can be subject to volume changes. In the limiting case of T=1 (i.e. the whole audio content is taken as a frame) the resulting matrix of transformed coefficients 208 is a F-dimensional column vector, and this normalization can render the normalized coefficients invariant to volume changes.

Figure 5:
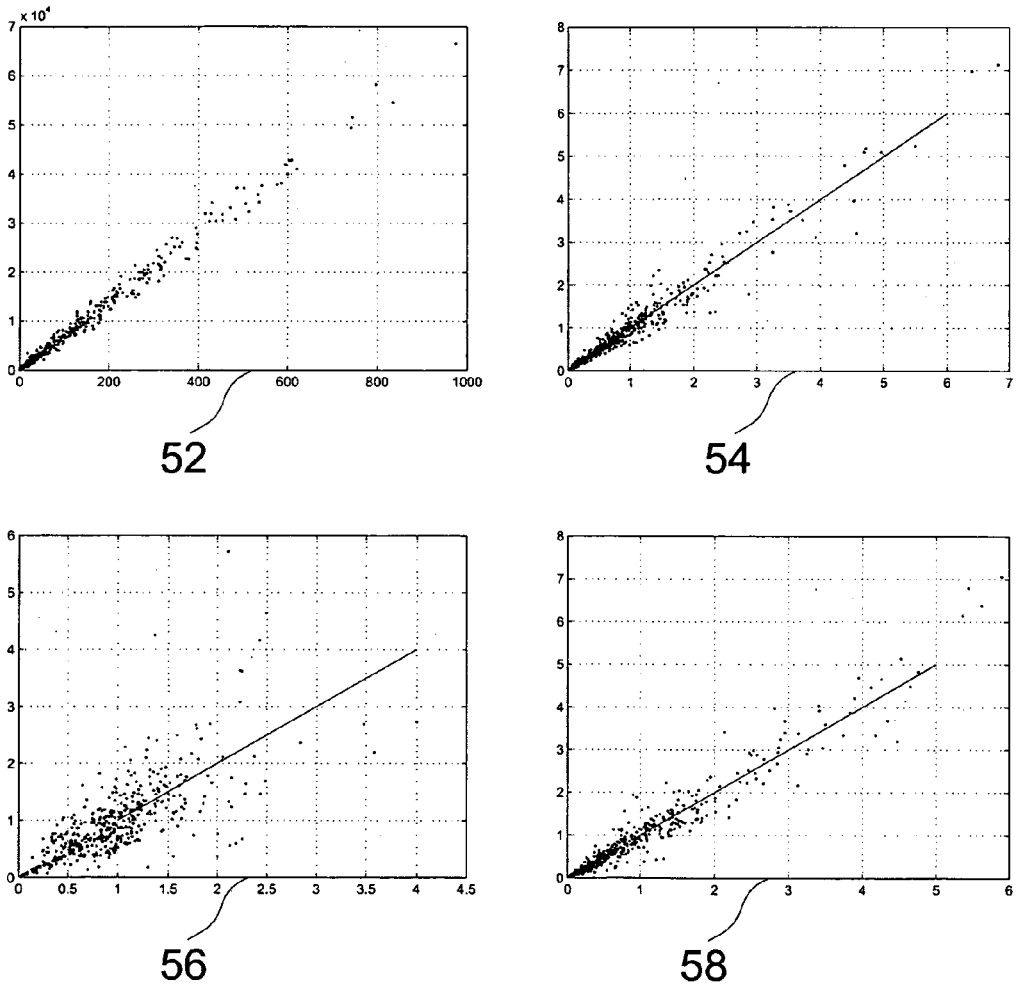
FIG. 5 illustrates the properties of the normalization used in the present invention.

There are numerous embodiments of the transform 206 that can take advantage of the properties of the normalization described above. In one exemplary embodiment, each transformed coefficient is regarded as a DFT coefficient. The transform 206 simply computes the Discrete Fourier Transform (DFT) of size $M_d$ for each windowed frame 204. For a set of DFT indices in a predefined range from $i_1$ to $i_2$, their squared modulus is computed. The result is then stored in each element X(f,t) of the matrix of transformed coefficients 208, which can be seen in this case as a time-frequency matrix. Therefore, $X(f,t)=|v(f,t)|^2$, with v(f,t) the DFT coefficient of the frame t at the frequency index f. If X(f,t) is one coefficient of the time-frequency matrix obtained from a reference audio content, and X*(f,t) is the coefficient obtained from the same content distorted by multipath audio propagation, then it holds that $$X^*(f,t)\approx C_f\times X(f,t),\ 1\le t\le T \tag{11}$$

where $C_f$ is a constant given by the squared amplitude of the multipath channel at the frequency with index f. The approximation in (11) stems from the fact that the transform 206 works with frames of the audio content, which makes the linear convolution caused by multipath propagation to be not perfectly translated into a purely multiplicative effect. Therefore, as a result of the normalization 212, it comes clear that the output Y(f',t') 214, obtained according to the formula (1), is approximately invariant to distortions caused by multipath audio propagation, since both functions H( ), in the numerator, and G( ), in the denominator, are homogeneous of the same order and therefore $C_{f'}$ is nearly cancelled for each frequency index f'. In FIG. 5, a scatter plot 52 of X(f,t) vs. X*(f,t) is shown for a given DFT index. This embodiment is not the most advantageous, because performing the normalization in all DFT channels is costly due to the fact that the size of the matrix of transformed coefficients 208 will be very large, in general. Hence, it is preferable to perform the normalization in a reduced number of transformed coefficients.

In another exemplary embodiment, the transform 206 divides the spectrum in a given number $M_b$ of spectral bands, possibly overlapped. Each transformed coefficient X(f,t) is computed as the energy of the frame t in the corresponding band f, with $1\le M_b$. Therefore, with this embodiment the elements of the matrix of transformed coefficients 208 are given by $$X(f,t)=\sum_{i=1}^{M_d} e_f(i)\times v_t(i), \tag{12}$$

which in matrix notation can be more compactly written as $X(f,t)=e_f^T v_t$, where:

$v_t$ is a vector with the DFT coefficients of the audio frame t, $e_f$ is a vector with all elements set to one for the indices that correspond to the spectral band f, and zero elsewhere.

This second embodiment can be seen as a sort of dimensionality reduction by means of a linear transformat ion applied over the first embodiment. This linear transformation is defined by the projection matrix $$E=[e_1, e_2, \ldots, e_{M_b}]. \tag{13}$$

Thus, a smaller matrix of transformed coefficients 208 is constructed, wherein each element is now the sum of a given subset of the elements of the matrix of transformed coefficients constructed with the previous embodiment. In the limiting case where $M_b=1$, the resulting matrix of transformed coefficients 208 is a T-dimensional row vector, where each element is the energy of the corresponding frame.

After being distorted by a multipath channel, the coefficients of the matrix of transformed coefficients 208 are multiplied by the corresponding gains of the channel in each spectral band. In matrix notation, $X(f,t)\approx e_f^T D v_t$, where D is a diagonal matrix whose main diagonal is given by the squared modulus of the DFT coefficients of the multipath channel. If the magnitude variation of the frequency response of the multipath channel in the range of each spectral band is not too abrupt, then the condition (11) holds and thus approximate invariance to multipath distortion is ensured. If the frequency response is abrupt, as is usually the case with multipath channels, then it is preferable to increase the length of the normalization windows $L_l$ and $L_u$ in order to improve the robustness against multipath. Using the normalization (6) and the definition (7) of the function G( ) for p=2 and a=[1, 1, . . . , 1], then $G(\underline{X}_{f,t})$ is the power of the transformed coefficient with index f (which in this case corresponds to the fth spectral band) averaged in the past L frames. In matrix notation, this can be written as $$G(X_{f,t}) = \left(e_f^T\left(\frac{1}{L}\sum_{i=1}^{L} v_{t-i}v_{t-i}^T\right)e_f\right)^{\frac{1}{2}} = (e_f^T R_t e_f)^{\frac{1}{2}}. \tag{14}$$

If the audio content is distorted by a multipath channel, then $$G(X_{f,t}^*) \approx (e_f^T(DR_tD)e_f)^{\frac{1}{2}}. \tag{15}$$

The larger L, the more stable the values of the matrix $R_t$, hence improving the performance of the system. In FIG. 5, a scatter plot 54 of Y(f',t') vs. Y*(f',t') obtained with L=20 is shown for a given band f and the G function shown in (7). As can be seen, the plotted values are all concentrated around the unit-slope line, thus illustrating the quasi-invariance property achieved by the normalization.

In another embodiment, the transform 206 applies a linear transformation that generalizes the one described in the previous embodiment. This linear transformation considers an arbitrary projection matrix E, which can be randomly generated or obtained by means of PCA, ICA or similar dimensionality reduction procedures. In any case, this matrix is not dependent on each particular input matrix of transformed coefficients 208 but it is computed beforehand, for instance during a training phase. The objective of this linear transformation is to perform dimensionality reduction in the matrix of transformed coefficients, which according to the previous embodiments could be composed of the squared modulus of DFT coefficients $v_t$ or spectral energy bands according to equation (12). The latter choice is preferred in general because the method, specially its training phase, becomes computationally cheaper since the number of spectral bands is usually much smaller than the number of DFT coefficients. The normalized coefficients 214 hold similar properties to those shown for the previous embodiments. In FIG. 5, the scatter plot 56 shows Y(f',t') vs. Y*(f',t') for a given band f when $G(\underline{X}_{f,t})$ is set according to equation (7), L=20, and the projection matrix E is obtained by means of PCA. This illustrates again the quasi-invariance property achieved by the normalization.

In yet another embodiment, the transform block 206 simply computes the DFT transform of the windowed audio frames 204, and the rest of operations are deferred until the postprocessing step 216. However, it is preferable to perform the normalization 212 in a matrix of transformed coefficients as small as possible in order to save computations. Moreover, performing dimensionality reduction prior to the normalization has the positive effect of removing components that are too sensitive to noise, thus improving the effectiveness of the normalization and the performance of the whole system.

Other embodiments with different transforms 206 are possible. Another exemplary embodiment performs the same operations as the embodiments described above, but replacing the DFT by the Discrete Cosine Transform (DCT). The corresponding scatter plot 58 is shown in FIG. 5 when $G(\underline{X}_{f,t})$ is set according to equation (7), L=20, p=2, and the projection matrix is given by the matrix shown in (13). The transform can be also the Discrete Wavelet Transform (DWT). In this case, each row of the matrix of transformed coefficients 208 would correspond to a different wavelet scale.

In another embodiment, the invention operates completely in the temporal domain, taking advantage of Parseval's theorem. The energy per sub-band is computed by filtering the windowed audio frames 204 with a filterbank wherein each filter is a bandpass filter that accounts for a spectral sub-band. The rest of operations of 206 are performed according to the descriptions given above. This operation mode can be particularly useful for systems with limited computational resources.

Any of the embodiments of 206 described above can apply further linear operations to the matrix of transformed coefficients 208, since in general this will not have any negative impact in the normalization. An example of useful linear operation is a high-pass linear filtering of the transformed coefficients in order to remove low-frequency variations along the t axis of the matrix of transformed coefficients, which are non-informative.

Figure 6:
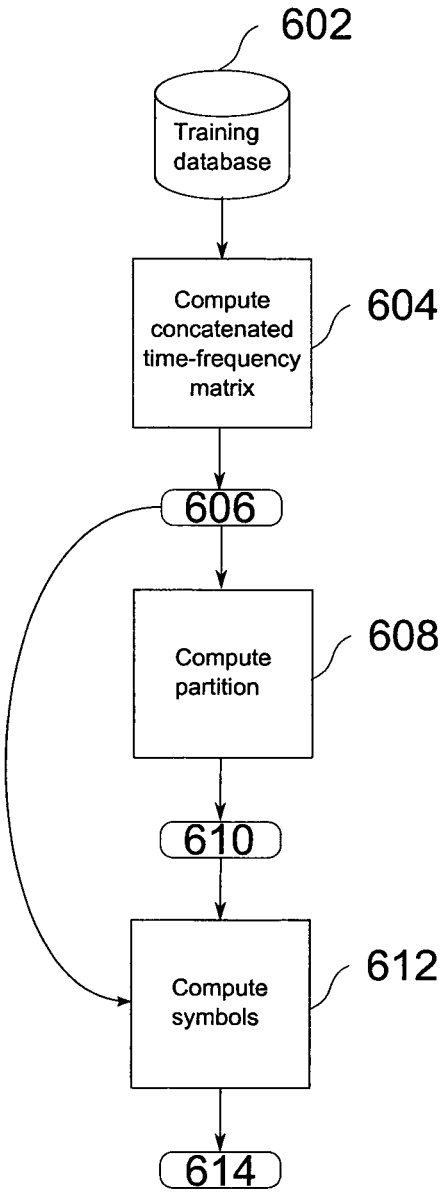
FIG. 6 is a block diagram illustrating the method for training the quantizer.

Regarding the quantization 220, the choice of the most appropriate quantizer can be made according to different requirements. The invention can be set up to work with vector quantizers, but the embodiments described here consider only scalar quantizers. One of the main reasons for this choice is computational, as explained above. For a positive integer Q>1, a scalar Q-level quantizer is defined by a set of Q−1 thresholds that divide the real line in Q disjoint intervals (a.k.a. cells), and by one symbol (a.k.a. reconstruction level or centroid) associated to each quantization interval. The quantizer assigns to each postprocessed coefficient an index q in the alphabet {0, 1, . . . , Q−1}, depending on the interval where it is contained. The conversion of the index q to the corresponding symbol $S_q$ is necessary only for the comparison of robust hashes, to be described below. Even if the quantizer can be arbitrarily chosen, the present invention considers a training method for constructing an optimized quantizer that consists of the following steps, illustrated in FIG. 6.

First, a training set 602 consisting on a large number of audio fragments, is compiled. These audio fragments do not need to contain distorted samples, but they can be taken entirely from reference (i.e. original) audio fragments. The second step 604 applies the procedures illustrated in FIG. 2 (windowing 202, transform 206, normalization 212, postprocessing 216), according to the description above, to each of the audio fragments in the training set. Hence, for each audio fragment a matrix of postprocessed coefficients 218 is obtained. The matrices computed for all training audio fragments are concatenated along the t dimension in order to create a unique matrix of postprocessed coefficients 606 containing information from all fragments. Each row $r_{f'}$, with $1 \le f' \le F'$, has length $L_c$.

For each row $r_{f'}$ of the matrix of postprocessed coefficients 606, a partition $\mathcal{P}_{f'}$ of the real line in Q disjoint intervals is computed 608 in such a way that the partition maximizes a predefined cost function. One appropriate cost function is the empirical entropy of the quantized coefficients, which is computed according to the following formula:

$$Ent(\mathcal{P}_f) = -\sum_{i=1}^{Q} (N_{i,f}/L_c)\log(N_{i,f}/L_c), \tag{16}$$

where $N_{if}$ is the number of coefficients of the fth row of the matrix of postprocessed coefficients 606 assigned to the ith interval of the partition $\mathcal{P}_f$. When (16) is maximum (i.e. it approaches log(Q)), the output of the quantizer conveys as much information as possible, thus maximizing the discriminability of the robust hash. Therefore, a partition optimized for each row of the concatenated matrix of postprocessed coefficients 606 is constructed. This partition consists of a sequence of Q−1 thresholds 610 arranged in ascending order. Obviously, the parameter Q can be different for the quantizer of each row.

Finally, for each of the partitions obtained in the previous step 608, one symbol associated. to each interval is computed 612. Several methods for computing such symbols 614 can be devised. The present invention considers, among others, the centroid that minimizes the average distortion for each quantization interval, which can be easily computed by computing the conditional mean of each quantization interval, according to the training set. Another method for computing the symbols, which is obviously also within the scope of the present invention, consists in assigning to each partition interval a fixed value according to a Q-PAM (Pulse Amplitude Modulation of Q levels). For instance, for Q=4 the symbols would be $\{-c_2, -c_1, c_1, c_2\}$ with $c_1$ and $c_2$ two real, positive numbers.

The method described above yields one quantizer optimized for each row of the matrix of postprocessed coefficients 218. The resulting set of quantizers can be non-uniform and non-symmetric, depending on the properties of the coefficients being quantized. The method described above gives support, however, to more standard quantizers by simply choosing appropriate cost functions. For instance, the partitions can be restricted to be symmetric, in order to ease hardware implementations. Also, for the sake of simplicity, the rows of the matrix of postprocessed coefficients 606 can be concatenated in order to obtain a single quantizer which will be applied to all postprocessed coefficients.

In the absence of normalization 212, the use of a multilevel quantizer would cause a huge performance loss because the boundaries of the quantization intervals would not be adapted to the distortions introduced by the, microphone-capture channel. Thanks to the properties induced by the normalization 212 it is ensured that the quantization procedure is still effective even in this case. Another advantage of the present invention is that by making the quantizer dependent on a training set, and not on the particular audio content that is being hashed, the robustness against severe distortions is greatly increased.

After performing the quantization 220, the elements of the quantized matrix of postprocessed coefficients are arranged columnwise in a vector. The elements of the resulting vector, which are the indices of the corresponding quantization intervals, are finally converted to a binary representation for the sake of compactness. The resulting vector constitutes the final hash 110 of the audio content 102.

Figure 3:
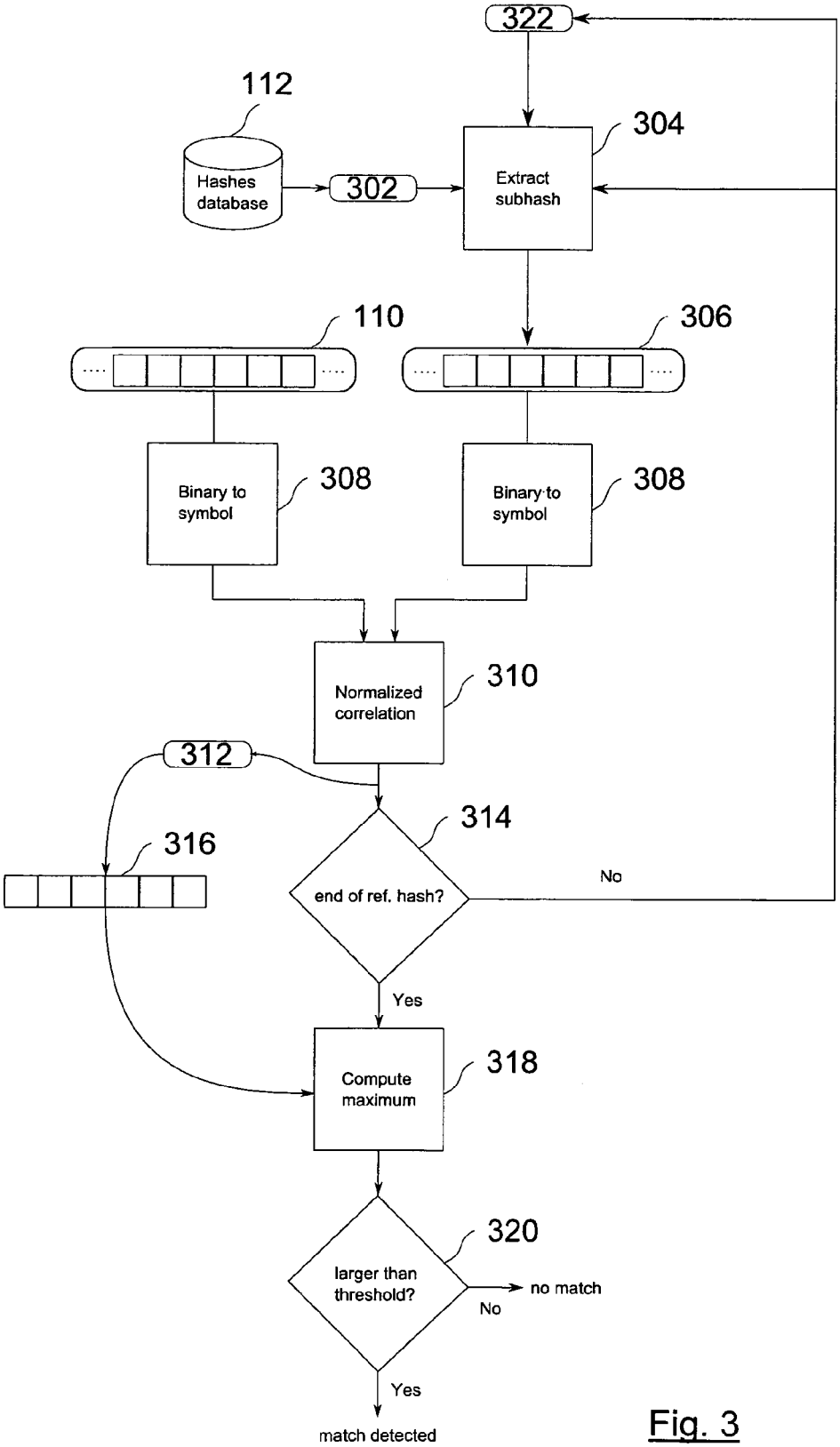
FIG. 3 illustrates the method for comparing a robust hash extracted from a fragment of an audio content against a selected hash contained in a database.

The objective of comparing two robust hashes is to decide whether they represent the same audio content or not. The comparison method is illustrated in FIG. 3. The database 112 contains reference hashes, stored as vectors, which were precomputed on the corresponding reference audio contents. The method for computing these reference hashes is the same described above and illustrated in FIG. 2. In general, the reference hashes can be longer than the hash extracted from the query audio content, which is usually a small audio fragment. In what follows we assume that the temporal length of the hash 110 extracted from the audio query is J, which is smaller than that of the reference hashes. Once a reference hash 302 is selected in 112, the comparison method begins by extracting 304 from it a shorter sub-hash 306 of length J. The first element of the first sub-hash is indexed by a pointer 322, which is initialized to the value 1. Then, the elements of the reference hash 302 in the positions from 1 to J are read in order to compose the first reference sub-hash 306.

Unlike most comparison methods provided in the existing art, which use Hamming distance to compare hashes, we use the normalized correlation as an effective similarity measure. It has been experimentally checked that in our application the normalized correlation significantly improves the performance offered by p-norm distances or the Hamming distance. The normalized correlation measures the similarity between two hashes as their angle cosine in J-dimensional space. Prior to computing the normalized correlation, it is necessary to convert 308 the binary elements of the sub-hash 306 and the query hash 110 into, the real-valued symbols (i.e. the reconstruction values) given by the quantizer. Once this conversion has been done, the computation of the normalized correlation can be performed. In what follows we denote the query hash 110 by $h_q$, and the reference sub-hash 306 by $h_r$. The normalized correlation 310 computes the similarity measure 312, which always lies in the range [−1, 1], according to the following rule:

$$C = \frac{\sum_{i=1}^{J} h_q(i) \times h_r(i)}{\mathrm{norm}_2(h_q) \times \mathrm{norm}_2(h_r)}, \tag{17}$$

where $$\mathrm{norm}_2(h) = \left(\sum_{i=1}^{J} h(i)^2\right)^{\frac{1}{2}}. \tag{18}$$

The closer to 1, the greater the similarity between the two hashes. Conversely, the closer to −1, the more different they are.

The result of the normalized correlation 312 is temporarily stored in a buffer 316. Then, it is checked 314 whether the reference hash 302 contains more sub-hashes to be compared. If it is the case, a new sub-hash 306 is extracted again by increasing the pointer 322 and taking a new vector of J elements of 302. The value of the pointer 322 is increased in a quantity such that the first element of the next sub-hash corresponds to the beginning of the next audio frame. Hence, such quantity depends both on the duration of the frame and the overlapping between frames. For each new sub-hash, a normalized correlation value 312 is computed and stored in the buffer 316. Once there are no more sub-hashes to be extracted from the reference hash 302, a function of the values stored in the buffer 316 is computed 318 and compared 320 to a threshold. If the result of such function is larger than this threshold, then it is decided that the compared hashes represent the same audio content. Otherwise, the compared hashes are regarded to as ,belonging to different audio contents. There are numerous choices for the function to be computed on the normalized correlation values. One of them is the maximum—as depicted in FIG. 3—, but other choices (mean value, for instance) would also be suitable. The appropriate value for the threshold is usually set according to empirical observations, and it will be discussed below.

The method described above for comparison is based on an exhaustive search. A person skilled in the art may realize that such method based on computing the normalized correlation can be coupled with more efficient methods for performing searches on large databases, as described in the existing art, if specific efficiency constraints must be met.

In a preferred embodiment, the invention is configured according to the following parameters, which have shown very good performance in practical systems. First, the fragment of the audio query 102 is resampled to 11250 Hz. The duration of an audio fragment for performing a query is set to 2 seconds. The overlapping between frames is set to 90%, in order to cope with desynchronizations, and each frame $\{fr_t\}$, with $1 \leq t \leq T$ is windowed by a Hanning window. The length N of each frame $fr_t$ is set to 4096 samples, resulting in 0.3641 seconds. In the transform procedure 206, each frame is transformed by means of a Fast Fourier Transform FFT of size 4096. The FFT coefficients are grouped in 30 critical subbands in the range $[f_1, f_c]$ (Hz). The values used for the cut frequencies are $f_l$300, $f_c$=2000, motivated by two reasons:

1. Most of the energy of natural audio signals is concentrated in low frequencies, typically below 4 KHz, and the non-linear distortions introduced by sound reproduction and acquisition systems are stronger for high frequencies.

2. Very low frequencies are imperceptible for the humans and usually contain spurious information. In the case of capturing audio with built-in laptop microphones, frequency components below 300 Hz typically contain a big amount of fan noise.

The limits of each critical band are computed according the well known Mel scale, which mimics the properties of the Human Auditory System. For each of the 30 critical subbands, the energy of the DFT coefficients is computed. Hence, a matrix of transformed coefficients of size 30×44 is constructed, where 44 is the number of frames T contained in the audio content 102. Next, a linear band-pass filter is applied to each row of the time-frequency matrix in order to filter out spurious effects such as non-zero mean values and high-frequency variations. A further processing applied to the filtered matrix of transformed coefficients is dimensionality reduction using a modified PCA approach that consists on the maximization of the Fourth Order moments of a training set of original audio contents. The resulting matrix of transformed coefficients 208 computed from the 2 seconds fragment is of size F×44, with F≤30. The dimensionality reduction allows to reduce F down to 12 yet keeping high audio identification performance.

For the normalization 212 the function (6) is used, together with the function G( ) as given by (7), resulting in a matrix of normalized coefficients of size F×43, with F≤30. As explained above, the parameter p can take any real positive value. It has been experimentally checked that the optimum choice for p, in the sense of minimizing the error probabilities, is in the range [1,2]. In particular, the preferred embodiment uses the function with p=1.5. The weighting vector is fixed as a=[1, 1, . . . , 1]. It remains to set the value of the parameter L, which is the length of the normalization window. As explained above, a tradeoff exists between robustness to noise and adaptation time to channel variations. If the microphone-capture channel varies very fast, a possible solution for keeping a large L is to increase the audio sampling rate. Hence, the optimal value for L is application-dependent. In the preferred embodiment L is set to 20. Therefore, the duration of the normalization window is 1.1 seconds, which for typical applications of audio identification is sufficiently small.

In the preferred embodiment, the postprocessing 216 is set to the identity function, which in practice is equivalent to not performing any postprocessing. The quantizer 220 uses 4 quantization levels, wherein the partition and the symbols are obtained according to the methods described above (entropy maximization and conditional mean centroids) applied on a training set of audio signals.

Figure 7:
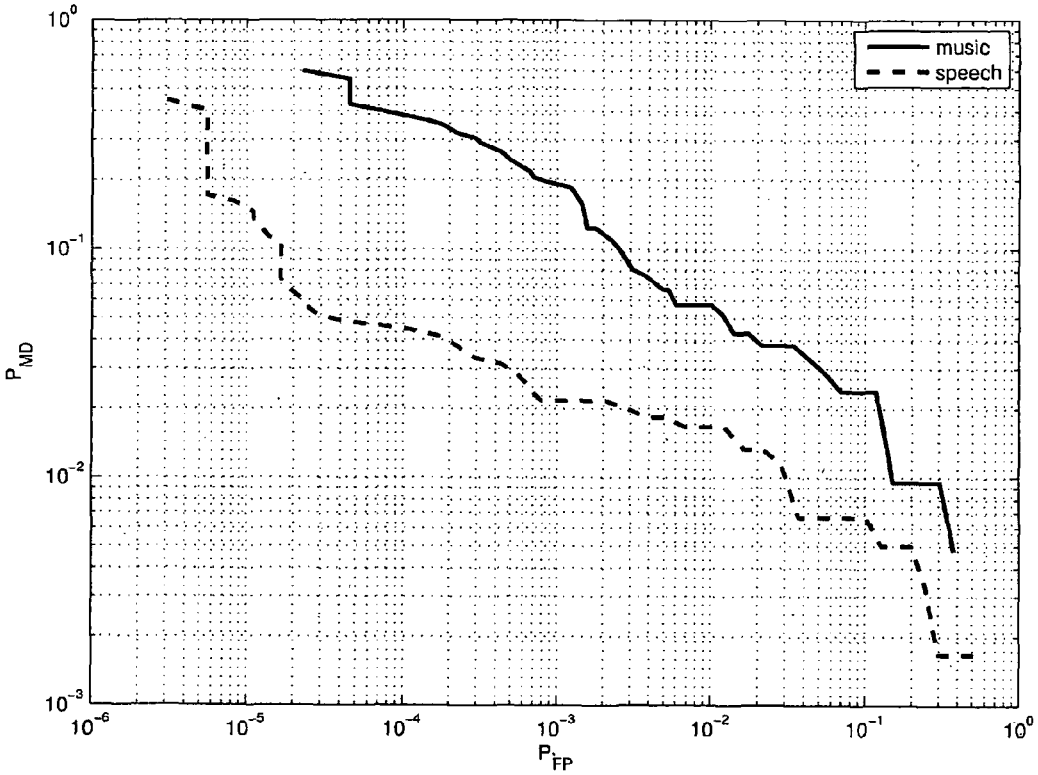
FIG. 7 shows the Receiver Operating Characteristic (ROC) for the preferred embodiment.
Figure 8:
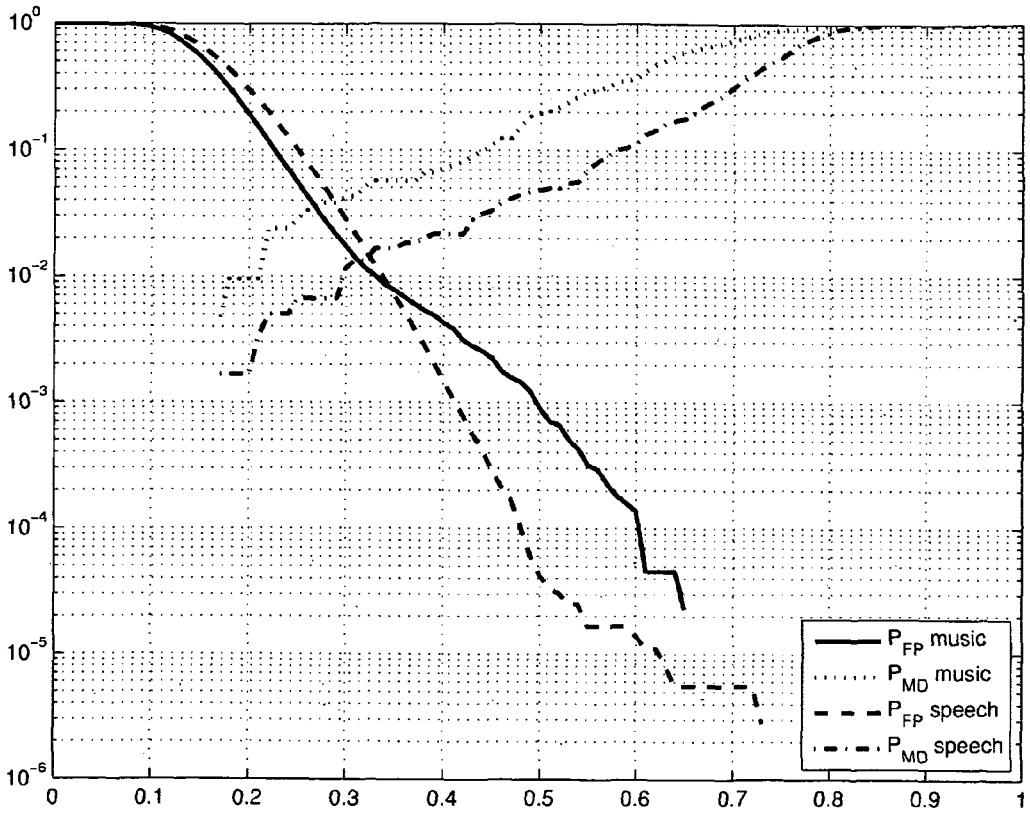
FIG. 8 shows $P_{FP}$ and $P_{MD}$ for the preferred embodiment.

FIG. 7 and FIG. 8 illustrate the performance of the preferred embodiment in a real scenario, where the audio identification is done by capturing an audio fragment of two seconds using the built-in microphone of a laptop computer at 2.5 meters from the audio source in a living-room. As reflected in FIGS. 7 and 8, the performance has been tested in two different cases: identification of music fragments, and identification of speech fragments. Even if the plots show a severe performance degradation for music compared to speech, the value of P is still lower than 0.2 for $P_{FP}$ below $10^{-3}$, and lower than 0.06 for $P_{FP}$ below $10^{-2}$.

Figure 9:
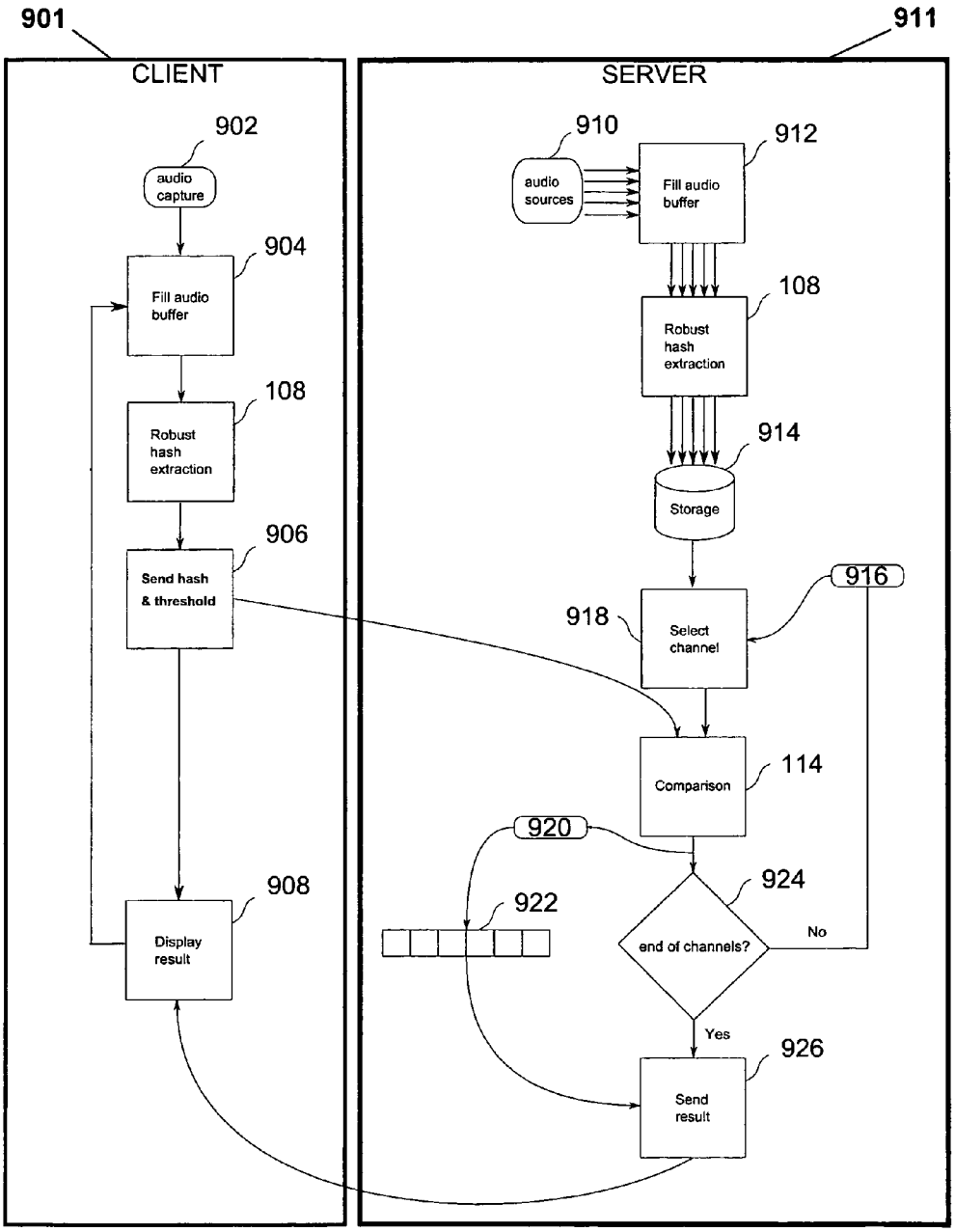
FIG. 9 is a block diagram illustrating the embodiment of the invention for identifying audio in streaming mode.

FIG. 9 depicts the general block diagram of an embodiment that makes use of the present invention for performing audio identification in streaming mode, in real time. One could use the present embodiment, for instance, for performing continuous identification of broadcast audio. This exemplary embodiment uses a client-server architecture which is explained below. All the parameters set in the preferred embodiment described above are kept.

1. The client 901 receives an audio stream through some capture device 902, which can be for instance a microphone coupled to an A/D converter. The received audio samples are consecutively stored in a buffer 904 of predetermined length which equals the length of the audio query. When the buffer is full, the audio samples are read and processed 108 according to the method illustrated in FIG. 2 in order to compute the corresponding robust hash.

2. The robust hash, along with a threshold predefined by the client, are submitted 906 to the server 911. The client 901 then waits for an answer of the server 911. Upon reception of such answer, it is displayed 908 by the client.

3. The server is configured to receive multiple audio streams 910 from multiple audio sources, hereinafter channels. Similarly to the client, the received samples of each channel are consecutively stored in a buffer 912. However, the length of the buffer in this case is not the same as the length of the audio query. Instead, the buffer 912 has a length which equals the number of samples N of an audio frame. Furthermore, such buffer is a circular buffer which is updated every $n_0$ samples, where $n_0$ is the number of non-overlapping samples.

4. Every time $n_0$ new samples of a given channel are received, the server computes 108 the robust hash of the channel samples stored in the corresponding buffer, which form a complete frame. Each new hash is consecutively stored in a buffer 914, which is implemented again as a circular buffer. This buffer has a predetermined length, significantly larger than that of the hash corresponding to the query, in order to accommodate possible delays at the client side and the delays caused by the transmission of the query through data networks.

5. When a hash is received from the client, a comparison 114 (illustrated in FIG. 3) is performed between the received hash (query hash 110) and each of the hashes stored in the channel buffers 914. First, a pointer 916 is set to 1 in order to select 918 the first channel. The result 920 of the comparison (match/no match) is stored in a buffer 922. If there are more channels left to be compared, the pointer 916 is increased accordingly and a new comparison is performed. Once the received hash has been compared with all channels, the result 920—identifying the matching channel if there is a match—is sent 926 to the client, which finally displays 908 the result.

The client keeps on submitting new queries at regular intervals (which equals the duration of the buffer 904 at the client) and receiving the corresponding answers from the server. Thus, the identity of the audio captured by the client is regularly updated.

As summarized above, the client 901 is only responsible for extracting the robust hash from the captured audio, whereas the server 911 is responsible for extracting the hashes of all the reference channels and performing the comparisons whenever it receives a query from the client. This workload distribution has several advantages: firstly, the computational cost on the client is very low, and secondly, information that is transferred between client and server allows for a very low transmission rate.

When used in streaming mode as described here, the present invention can take full advantage of the normalization operation 212 performed during the extraction of the hash 108. More specifically, the buffer 210 can be used to store a sufficient number of past coefficients in order to have always L coefficients for performing the normalization. As shown before in equations (4) and (5), when working in offline mode (that is, with an isolated audio query) the normalization cannot always use L past coefficients because they may not be available. Thanks to the use of the buffer 210 it is ensured that L past coefficients are always available, thus improving the overall identification performance. When the buffer 210 is used, the hash computed for a given audio fragment will be dependent on a certain number of audio fragments that were previously processed. This property makes the invention to be highly robust against multipath propagation and noise effects when the length L of the buffer is sufficiently large.

The buffer 210 at time t contains one vector (5) per row of the matrix of transformed coefficients. For an efficient implementation, the buffer 210 is a circular buffer where for each new analyzed frame, the most recent element X(f,t) is added and the oldest element X(f,t−L) is discarded. If the most recent value of $G(\underline{X}_{f,t})$ is conveniently stored, then if $G(\underline{X}_{f,t})$ is given by (7), its value would be updated simply as follows:

$$G(\underline{X}_{f,t+1}) = \left(G^2(\underline{X}_{f,t}) + \frac{1}{L}(|X(f,t)|^2 - |X(f,t-L)|^2)\right)^{\frac{1}{2}}. \tag{19}$$

Hence, for each new analyzed frame, the computation of the normalization factor only requires two simple arithmetic operations, regardless of the length of the buffer L.

When operating in streaming mode, the client 901 receives the results of the comparisons performed by the server 911. In case of having more than one match, the client selects the match with the highest normalized correlation value. Assuming that the client is listening to one of the channels being monitorized by the server, three types of events are possible:

1. The client may display an identifier that corresponds to the channel whose audio is being captured. We say that the client is "locked" to the correct channel.

2. The client may display an identifier that corresponds to an incorrect channel. We say the client is "falsely locked".

3. The client may not display any identifier because the server has not found any match. We say the client is "unlocked". This happens when there is no match.

Figure 10:
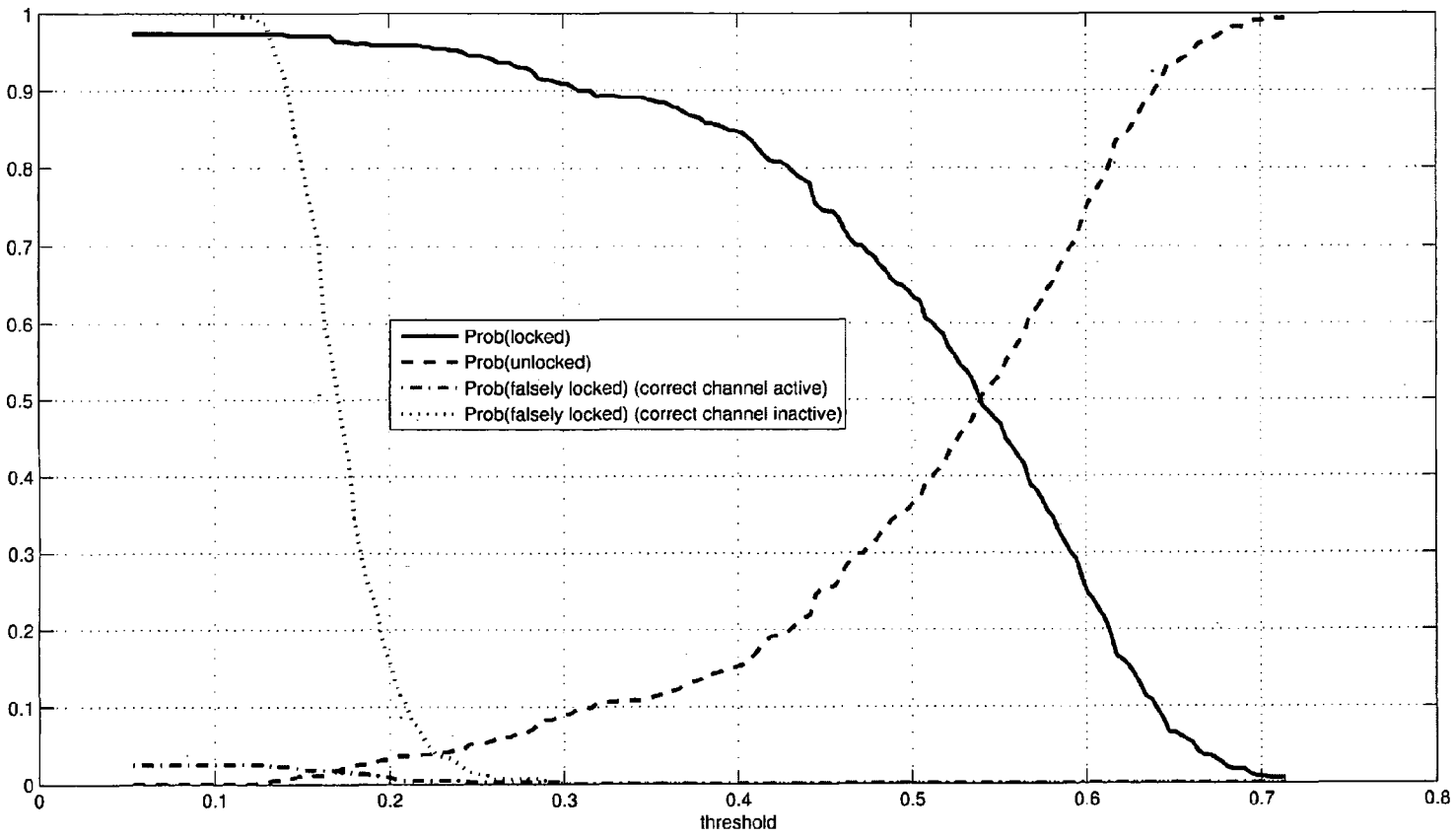
FIG. 10 shows plots of the probability of correct operation and the different probabilities of error when using the. embodiment of the invention for identifying audio in streaming mode.

When the client is listening to an audio channel which is not any of the channels monitorized by the server, then the client should be always unlocked. Otherwise, the client would be falsely locked. When performing continuous identification of broadcast audio, it is desirable to be correctly locked as much time as possible. However, the event of being falsely locked is highly undesirable, so in practice its probability must be kept very small. FIG. 10 shows the probability of occurrence of all possible events, empirically obtained, in terms of the threshold used for declaring a match. The experiment was conducted in a real environment where the capturing device was the built-in microphone of a laptop computer. As can be seen, the probability of being falsely locked is negligible for thresholds above 0.3 while keeping the probability of being correctly locked very high (above 0.9). This behavior has been found to be quite stable in experiments with other laptops and microphones.

The invention claimed is:

1. A method for robust audio hashing, comprising a robust hash extraction step wherein a robust hash is extracted from audio content; the robust hash extraction step comprising:

dividing the audio content in at least one frame;

applying a transformation procedure on said at least one frame to compute, for each frame, a plurality of transformed coefficients;

applying a normalization procedure on the transformed coefficients to obtain a plurality of normalized coefficients, wherein said normalization procedure comprises computing the product of the sign of each coefficient of said transformed coefficients by the quotient of two homogeneous functions of any combination of said transformed coefficients, wherein both homogeneous functions are of the same order;

applying a quantization procedure on said normalized coefficients to obtain the robust hash of the audio content.

2. The method according to claim 1, further comprising a comparison step wherein the robust hash is compared with at least one reference hash to find a match.

3. The method according to claim 2, wherein the comparison step comprises, for each reference hash:

extracting from the corresponding reference hash at least one sub-hash with the same length J as the length of the robust hash;

converting the robust hash and each of said at least one sub-hash into the corresponding reconstruction symbols given by the quantizer;

computing a similarity measure according to the normalized correlation between the robust hash and each of said at least one sub-hash according to the following rule:

$$C = \frac{\sum_{i=1}^{J} h_q(i) \times h_r(i)}{\mathrm{norm}_2(h_q) \times \mathrm{norm}_2(h_r)},$$

where $h_q$ represents the robust hash of lengh J, $h_r$ a reference sub-hash of the same length J, and where $$\mathrm{norm}_2(h) = \left(\sum_{i=1}^{J} h(i)^2\right)^{\frac{1}{2}};$$

comparing a function of said at least one similarity measure against a predefined threshold;

deciding, based on said comparison, whether the robust hash and the reference hash represent the same audio content.

4. The method according to claim 1, wherein the normalization procedure is applied on the transformed coefficients arranged in a matrix of size F×T to obtain a matrix of normalized coefficients of size F'×T', with F'=F, T'≤T, whose elements Y(f't') are computed according to the following rule:

$$Y(f', t') = \frac{\text{sign}(X(f', M(t'))) \times H(X_{f'})}{G(X_{f'})},$$

where X(f', M(t')) are the elements of the matrix of transformed coefficients (208), $X_{f'}$ is the fth row of the matrix of transformed coefficients, M( ) is a function that maps indices from {1, . . . , T'} to {1, . . . , T}, and both H( ) and G( ) are homogeneous functions of the same order.

5. The method according to claim 4, wherein homogeneous functions H( ) and G( ) are such that:

$$H(X_{f'})=H(\overline{X}_{f',M(t')}),\ G(X_{f'})=G(\underline{X}_{f',M(t')}),$$

with $\overline{X}_{f',M(t')}$=[X(f',M(t')), X(f',M(t')+1), . . . , X(f',$k_u$)], $\underline{X}_{f',M(t')}$=[X(f',$k_l$), . . . , X(f',M(t')−2), X(f',M(t')−1], where $k_l$ is the maximum of {M(t')−$L_l$,1}, $k_u$ is the minimum of {M(t')+$L_u$−1,T}, M(t')>1, and $L_l$>1, $L_u$>0.

6. The method according to claim 5, wherein M(t')=t'+1 and H($\overline{X}_{f',M(t')}$)=abs(X(f',t'+1)), resulting in the following normalization rule:

$$Y(f', t') = \frac{X(f', t'+1)}{G(\underline{X}_{f',t'+1})}.$$

7. The method according to claim 6, wherein $$G(\underline{X}_{f',t'+1}) = L^{-\frac{1}{p}} \times (a(1) \times |X(f', t')|^p + a(2) \times |X(f', t'-1)|^p + \ldots + a(L) \times |X(f', t'-L+1)|^p)^{\frac{1}{p}},$$

where $L_l$=L, a=[a(1$_1$, a(2), . . . , a(L)] is a weighting vector and p is a positive real number.

8. The method according to claim 1, wherein the transformation procedure comprises a spectral subband decomposition of each frame.

9. The method according to claim 1, wherein in the quantization procedure at least one multilevel quantizer is employed.

10. The method according to claim 9, wherein the at least one multilevel quantizer is obtained by a training method comprising:

computing partition, obtaining Q disjoint quantization intervals by maximizing a predefined cost function which depend on the statistics of a plurality of normalized coefficients computed from a training set of training audio fragments; and computing symbols, associating one symbol to each interval computed.

11. The method according to claim 10, wherein the cost function is the empirical entropy of the quantized coefficients, computed according to the following formula:

$$Ent(\mathcal{P}_f) = -\sum_{i=1}^{Q} (N_{i,f} / L_c)\log(N_{i,f} / L_c),$$

where $N_{i,f}$ is the number of coefficients of the fth row of the matrix of postprocessed coefficients assigned to the ith interval of the partition, and $L_c$ is the length of each row.

12. A method for deciding whether two robust hashes computed according to the method for robust audio hashing of claim 1 represent the same audio content, wherein said method comprises:

extracting from the longest hash at least one sub-hash with the same length J as the length of the shortest hash;

converting the shortest hash and each of said at least one sub-hash into the corresponding reconstruction symbols given by the quantizer;

computing a similarity measure according to the normalized correlation between the shortest hash and each of said at least one sub-hash according to the following rule:

$$C = \frac{\sum_{i=1}^{J} h_q(i) \times h_r(i)}{\text{norm}_2(h_q) \times \text{norm}_2(h_r)},$$

where $h_q$ represents the query hash of lengh J, $h_r$ a reference sub-hash of the same length J, and where $$\text{norm}_2(h) = \left(\sum_{i=1}^{J} h(i)^2\right)^{\frac{1}{2}};$$

comparing a function of said at least one similarity measure against a predefined threshold;

deciding, based on said comparison, whether the two robust hashes represent the same audio content.

* * * * *